US011571059B2

(12) United States Patent
Newell et al.

(10) Patent No.: US 11,571,059 B2
(45) Date of Patent: Feb. 7, 2023

(54) ANTI-SLOSHING LIQUID-RETAINING BOTTLES

(71) Applicant: Innovative Drive Corporation, Reno, NV (US)

(72) Inventors: Matthew Byrnes Newell, Reno, NV (US); Luke Clauson, Reno, NV (US); Curt LaBelle, Harrison, NY (US); Michael Raye, Reno, NV (US)

(73) Assignee: INNOVATIVE DRIVE CORPORATION, Reno, NV (US)

( * ) Notice: Subject to any disclaimer, the term of this patent is extended or adjusted under 35 U.S.C. 154(b) by 39 days.

(21) Appl. No.: 17/120,912

(22) Filed: Dec. 14, 2020

(65) Prior Publication Data

US 2021/0093075 A1 Apr. 1, 2021

Related U.S. Application Data

(63) Continuation-in-part of application No. 16/379,249, filed on Apr. 9, 2019, now Pat. No. 10,863,840.

(60) Provisional application No. 62/655,161, filed on Apr. 9, 2018.

(51) Int. Cl.

| | |
|---|---|
| ***A45F 3/18*** | (2006.01) |
| ***B65D 23/02*** | (2006.01) |
| ***A61J 9/00*** | (2006.01) |
| ***A61J 9/04*** | (2006.01) |
| *A45F 3/00* | (2006.01) |

(52) U.S. Cl.

CPC ..... *A45F 3/18* (2013.01); *A61J 9/001* (2013.01); *A61J 9/04* (2013.01); *B65D 23/02* (2013.01); *A45F 2003/001* (2013.01)

(58) Field of Classification Search

CPC ..... A47G 19/2266; A47G 19/2205; A61J 11/002; A61J 11/001; A61J 11/02; A61J 9/001; A61J 9/04; B65D 1/06; B65D 1/02; B65D 25/18; B65D 25/16; B65D 25/14; B65D 23/02; A45F 3/18

USPC ..... 215/11.3, 11.5, 11.4, 2, 380; 220/529, 220/530, 723, 720, 703, 714, 711

See application file for complete search history.

(56) References Cited

U.S. PATENT DOCUMENTS

| | | | |
|---|---|---|---|
| 5,127,554 | A | 7/1992 | Loychuk |
| 5,497,920 | A | 3/1996 | Moeller et al. |
| 5,799,827 | A | 9/1998 | D'Andrade |

(Continued)

FOREIGN PATENT DOCUMENTS

| | | | |
|---|---|---|---|
| WO | 2010055057 | A1 | 5/2010 |

*Primary Examiner* — Robert J Hicks

(74) *Attorney, Agent, or Firm* — Aurora Consulting LLC; Ty Davis; Ashley Sloat

(57) ABSTRACT

Described herein are inserts for reducing sloshing in a bottle. The insert may be integrally formed in an outer shell of the bottle or removably insertable into the outer shell. The insert may include an elongate body extending between a first end opposite a second end; and an aperture defined by the elongate body and extending longitudinally through the elongate body between the first and second ends. The elongate body has an uncompressed state when removed from an outer shell and a compressed state when positioned in the outer shell. A diameter of the elongate body in the compressed state is less than or equal to a smallest diameter of the liquid retention compartment. The insert has a durometer between about 40 A and about 70 A. A volume of the insert is less than about 10% of a volume defined by the outer shell. The insert includes a compressible mesh material.

20 Claims, 29 Drawing Sheets

(56) References Cited

U.S. PATENT DOCUMENTS

| | | | |
|---|---|---|---|
| 5,819,980 | A | 10/1998 | Hill |
| 2015/0048117 | A1 | 2/2015 | Lam et al. |

ANTI-SLOSHING LIQUID-RETAINING BOTTLES

CROSS-REFERENCE TO RELATED APPLICATIONS

This application is a continuation-in-part of U.S. patent application Ser. No. 16/379,249, filed Apr. 9, 2019 and published as US20190307272A1 on Oct. 10, 2019; which claims the benefit of U.S. Provisional Patent Application Ser. No. 62/655,161 filed Apr. 9, 2018, the contents of each of which are herein incorporated by reference in their entireties.

INCORPORATION BY REFERENCE

All publications and patent applications mentioned in this specification are herein incorporated by reference in their entirety, as if each individual publication or patent application was specifically and individually indicated to be incorporated by reference in its entirety.

TECHNICAL FIELD

This disclosure relates generally to the field of liquid transport and anti-slosh devices, and more specifically to the field of anti-sloshing water bottles configured for use with athletic equipment or for tethering to a user. Described herein are anti-sloshing liquid-retaining bottles.

BACKGROUND

Elite-level athletes are constantly searching for ways to remove inefficiencies from their equipment, often by using the lightest components possible. One often overlooked inefficiency is the liquid and air mixture sloshing inside an athlete's water bottle. Because the water bottles are often mounted onto the user or their equipment, the sloshing caused by any activity or movement can have noticeable effects on the user and the handling of the equipment.

For example, cyclists' carry water bottles on their bicycle frames. The sloshing caused by pedaling, road forces, and turning can have a noticeable effect on the handling, and therefore the overall efficiency and performance, of the bicycle.

Further, for example, runners' carry water bottles on their body (e.g., their back, hips, in their hands, etc.). The sloshing caused by their legs and arms pumping and the pounding of the pavement can have a noticeable effect on the runner's efficiency and overall time.

Thus, there exists a need for new and useful anti-sloshing liquid bottles. Such new and useful anti-sloshing bottles are herein described.

SUMMARY

One aspect of the present disclosure is directed to an anti-sloshing bottle. In some embodiments, the anti-sloshing bottle may include an outer shell defining a liquid retention compartment configured for storing liquid; and a removable insert positionable in the liquid retention compartment of the outer shell. In some embodiments, the removable insert comprises an elongate body defining an aperture that longitudinally extends through the elongate body between a first end and a second end of the elongate body. In some embodiments, the removable insert has an uncompressed state when removed from the outer shell and a compressed state when positioned in the outer shell. In some embodiments, a diameter of the removable insert in the compressed state is less than or equal to a smallest diameter of the liquid retention compartment of the outer shell. In some embodiments, the removable insert has a durometer between about 40 A and about 70 A. In some embodiments, a volume of the removable insert is less than about 10% of a volume defined by the liquid retention compartment of the outer shell. In some embodiments, the removable insert comprises a compressible mesh material.

In some embodiments, the volume of the removable insert is less than about 1% of the volume defined by the outer shell.

In some embodiments, the compressible mesh material is selected from the group consisting of: a stainless steel mesh, an elastomeric waffle, an open cell foam, a polyurethane mesh, a silicone mesh, a thermoelastic mesh, or a combination thereof.

In some embodiments, the diameter of the removable insert in the compressed state is about 0.25 inches to about 1 inch.

In some embodiments, the elongate body defines a plurality of apertures that longitudinally extend through the elongate body between the first end and the second end.

In some embodiments, the anti-sloshing bottle further includes a mouthpiece movable between an open configuration and a closed configuration, such that in the open configuration, the mouthpiece is configured to expel the liquid.

In some embodiments, the removable insert prevents wave propagation through the liquid.

In some embodiments, the removable insert comprises or is formed of an antimicrobial material.

In some embodiments, a hub extends longitudinally through the aperture between the first and second ends of the elongate body. In some embodiments, one or more spokes extend from the hub to an internal surface of the elongate body to tether the hub to the elongate body. In some embodiments, there is an odd number of spokes or an even number of spokes.

Another aspect of the present disclosure is directed to a removable insert for reducing sloshing in a bottle. The insert includes an elongate body extending between a first end opposite a second end; and an aperture defined by the elongate body and extending longitudinally through the elongate body between the first and second ends. In some embodiments, the elongate body has an uncompressed state when removed from an outer shell and a compressed state when positioned in the outer shell. In some embodiments, a diameter of the elongate body in the compressed state is less than or equal to a smallest diameter of the liquid retention compartment of the outer shell. In some embodiments, the removable insert has a durometer between about 40 A and about 70 A. In some embodiments, a volume of the removable insert is less than about 10% of a volume defined by the outer shell. In some embodiments, the removable insert includes or is formed of a compressible mesh material. In some embodiments, the insert further includes the outer shell defining the liquid retention compartment configured for storing liquid.

In some embodiments, the volume of the removable insert is less than about 1% of the volume defined by the outer shell.

In some embodiments, the compressible mesh material is selected from the group consisting of: a stainless steel mesh, an elastomeric waffle, an open cell foam, a closed cell foam, a polyurethane mesh, a silicone mesh, a thermoelastic mesh, or a combination thereof.

In some embodiments, the diameter of the removable insert in the compressed state is about 0.25 inches to about 1 inch.

In some embodiments, the elongate body defines a plurality of apertures that longitudinally extend through the elongate body between the first end and the second end.

In some embodiments, the removable insert prevents wave propagation through the liquid.

In some embodiments, a hub extends longitudinally through the aperture between the first and second ends of the elongate body, and wherein one or more spokes extend from the hub to an internal surface of the elongate body to tether the hub to the elongate body.

Another aspect of the present disclosure is directed to an anti-sloshing bottle, including an outer shell defining a liquid retention compartment configured for storing liquid; and an insert comprising an elongate body defining an aperture that longitudinally extends through the elongate body between a first end and a second end of the elongate body. In some embodiments, an outer surface of the insert is irreversibly attached to an inner sidewall of the outer shell. In some embodiments, the insert has a durometer between about 40 A and about 70 A. In some embodiments, a volume of the insert is less than about 10% of a volume defined by the outer shell. In some embodiments, the insert comprises a mesh material.

Another aspect of the present disclosure is directed to an anti-sloshing bottle. In some embodiments, the bottle comprises: an outer shell defining a liquid retention compartment configured for storing non-carbonated liquid; a high-pressure reservoir defining an air retention compartment configured to maintain a pressure of less than or equal to 100 psi; a bladder fluidically coupled to a reduced pressure compartment, wherein the bladder is disposed within the outer shell, such that the bladder is configured to expand and contract within the outer shell in response to changes in pressure generated by the reduced pressure compartment; a purge button configured to close and open a release valve configured to vent the bladder to an atmosphere external to the outer shell; a pressure regulator assembly comprising a regulator housed between the reduced pressure compartment and an air retention compartment; and a mouthpiece configured to expel the non-carbonated liquid using pressure generated by the force of the bladder against the non-carbonated liquid stored in the liquid retention compartment formed by surfaces comprising the outer shell and the bladder.

In some embodiments, the regulator is configured to maintain a pressure differential between the reduced pressure compartment and the air retention compartment such that the pressure differential in the reduced pressure compartments is less than the pressure in the air retention compartment.

In some embodiments, the pressure in the air retention compartment is sufficient to expand or contract the bladder against the stored non-carbonated liquid.

In some embodiments, the air retention compartment is configured to maintain an initial pressure range of 40-100 psi.

In some embodiments, the air retention compartment is configured to maintain a pressure range of 10 psi to 80 psi after one fill cycle.

In some embodiments, the air retention compartment is configured to maintain a pressure range of 10 psi to 60 psi after two or more fill cycles.

In some embodiments, the outer shell is irreversibly coupled to the air retention compartment such that the irreversible coupling includes a seal configured to generate an air tight space between the outer shell and air retention compartment.

In some embodiments, the outer shell is reversibly coupled to the air retention compartment, such that the reversible coupling includes a seal configured to generate an air tight space between the outer shell and the air retention compartment.

In some embodiments, the bottle further includes a fill or Schrader or Presta valve configured to pressurize the air retention compartment, such that the air retention compartment is pressurized with air from the atmosphere external to the anti-sloshing water bottle.

In some embodiments, the air from the atmosphere is added to the air retention compartment via a manual method (e.g., bike pump); In other embodiments, the air from the atmosphere is added to the air retention compartment via an automatic method (e.g., automatic intake valve, suction through a valve, etc.).

In some embodiments, the air retention compartment is pressurized to a pressure range of 30-60 psi.

In some embodiments, the reduced pressure compartment is configured to retain a pressure of less than or equal to 40% of the pressure of the air retention compartment.

In some embodiments, the pressure of the air in the reduced pressure compartment is reduced by a factor of 1-30 by the regulator disposed between the reduced pressure compartment and the air retention compartment.

In some embodiments, the liquid retention compartment is configured for storing less than or equal to 24 ounces of non-carbonated liquid.

In some embodiments, the bladder is configured for storing less than or equal to 710 cubic centimeters ($cm^3$) of air. In some embodiments, the bladder is configured to store 100-200 $cm^3$; 200-300 $cm^3$; 300-400 $cm^3$; 400-500 $cm^3$; 500-600 $cm^3$; 600-700 $cm^3$; 700-800 $cm^3$; 700-710 $cm^3$; 705-715 $cm^3$; etc.

In some embodiments, the mouthpiece further includes a bite valve configured to utilize pressure supplied from the bladder to expel liquid from the liquid retention compartment at a constant rate, such that a rate of liquid expulsion is determined by the regulator of the pressure regulator assembly.

In some embodiments, a volume of air in the reduced pressure compartment is configured to expand in volume with the expansion of the bladder such that the bladder volumetrically displaces liquid as the liquid is expelled through the mouthpiece.

In some embodiments, the regulator of the air retention compartment is configured to expand the reduced pressure compartment comprising a volume of the bladder such that the bladder compresses the liquid retained in the liquid retention compartment to a pressure range of 1-5 psi.

In some embodiments, the bladder is configured to deflate and release air into the atmosphere through a purge or release valve.

In some embodiments, the regulator is a diaphragm regulator configured to keep the bladder at a constant pressure.

In some embodiments, the bottle further includes a depressible purge button configured to open and close a purge or release valve.

In some embodiments, the bottle further includes a depressible button configured to open and close a regulator housed within a pressure regulator assembly.

In some embodiments, the bottle further includes a depressible purge button configured to open the release or purge valve and close the regulator or the pressure regulator assembly or close the release valve and open the regulator of the pressure regulator assembly.

BRIEF DESCRIPTION OF THE DRAWINGS

The foregoing is a summary, and thus, necessarily limited in detail. The above-mentioned aspects, as well as other aspects, features, and advantages of the present technology are described below in connection with various embodiments, with reference made to the accompanying drawings.

Figure 1:
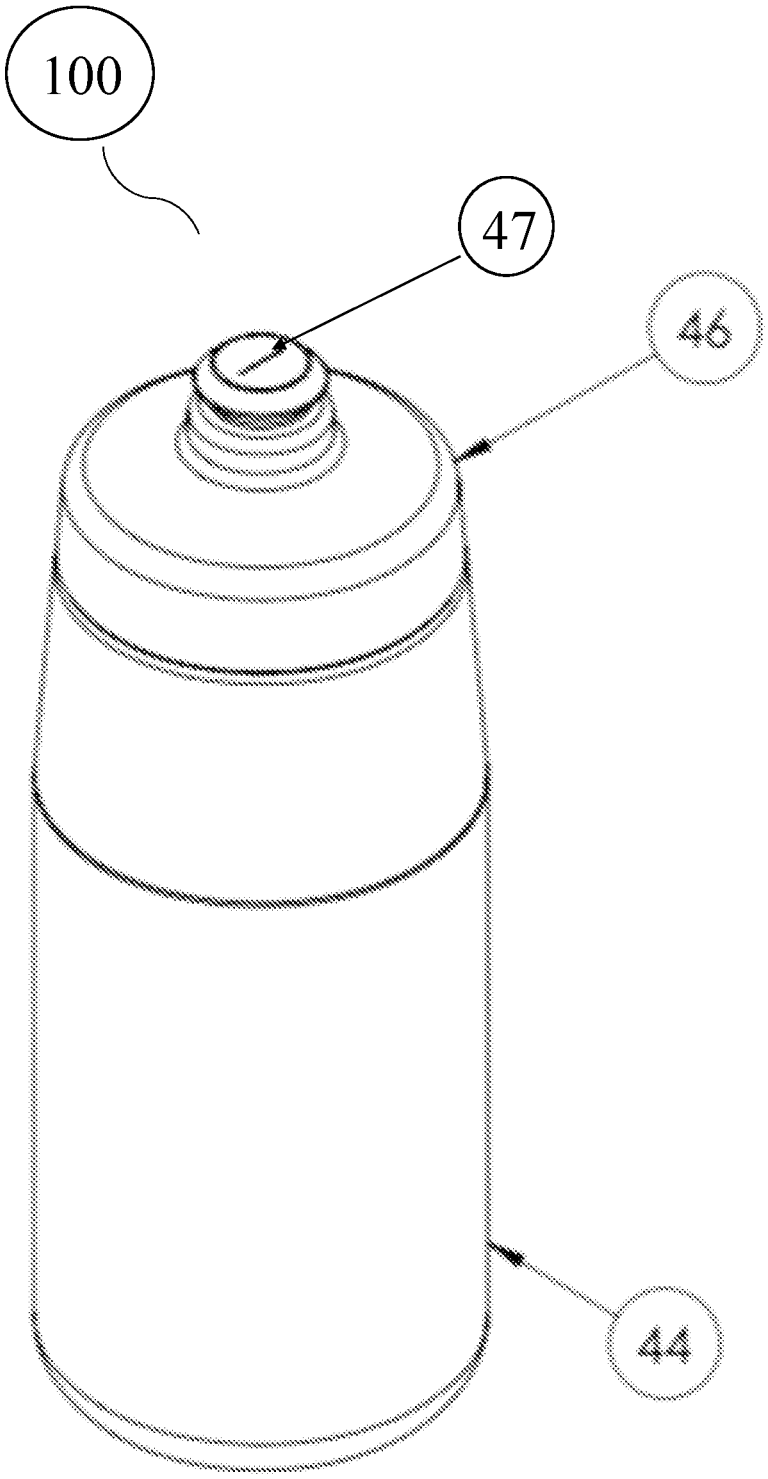
FIG. 1 illustrates one embodiment of an anti-sloshing liquid-retaining bottle.

The illustrated embodiments are merely examples and are not intended to limit the disclosure. The schematics are drawn to illustrate features and concepts and are not necessarily drawn to scale.

DETAILED DESCRIPTION

The foregoing is a summary, and thus, necessarily limited in detail. The above-mentioned aspects, as well as other aspects, features, and advantages of the present technology will now be described in connection with various embodiments. The inclusion of the following embodiments is not intended to limit the disclosure to these embodiments, but rather to enable any person skilled in the art to make and use the contemplated invention(s). Other embodiments may be utilized, and modifications may be made without departing from the spirit or scope of the subject matter presented herein. Aspects of the disclosure, as described and illustrated herein, can be arranged, combined, modified, and designed in a variety of different formulations, all of which are explicitly contemplated and form part of this disclosure.

Described herein are liquid bottles or containers that employ an internal anti-sloshing mechanism. In some embodiments, the anti-sloshing mechanism is configured to reduce or prevent wave propagation of a liquid in an outer shell. The outer shell may include a valve connected to a mouthpiece of the bottle to control the flow of liquid out of the bottle.

Described herein are liquid bottles or containers that employ an internal anti-sloshing mechanism. In some embodiments, the anti-sloshing mechanism is configured to apply compression forces against a non-carbonated liquid and an outer shell with a valve connected to a mouthpiece of the bottle to control the flow of liquid out of the bottle. For example, a pressure in a bladder in the bottle will allow a user to expel all air from the bottle before closing the valve. Once the air is eliminated from the bottle, the liquid can no longer slosh back and forth, resulting in increased efficiency for the user, for example a cyclist. When the user needs water, they open the valve, allowing water to automatically flow out of the pressurized bladder.

In some embodiments, the anti-sloshing mechanism is configured to break up waves in the liquid, so they cannot propagate, thus reducing the amount of sloshing that can be felt by the user.

In some embodiments, the anti-sloshing mechanism is configured to reversibly restrict an inflatable bladder using a series of springs, for example a constant force spring or leaf springs. Such restriction is configured to eliminate air from the bottle, thereby reducing liquid movement in the bottle.

As used herein, a user refers to a cyclist, athlete, runner, backpacker, outdoorsman, or any other individual that could benefit from restricting liquid movement in a container or bottle that they are carrying or transporting.

As used herein, a liquid includes, but is not limited to, water, sports drink, electrolyte solution, juice, tea, coffee, or any other beverage or solution that needs to be transported.

As used herein, any liquid retaining member (e.g., outer shell, bladder, liquid retention compartment, insert, etc.) may be resusable or disposable.

Figure 2:
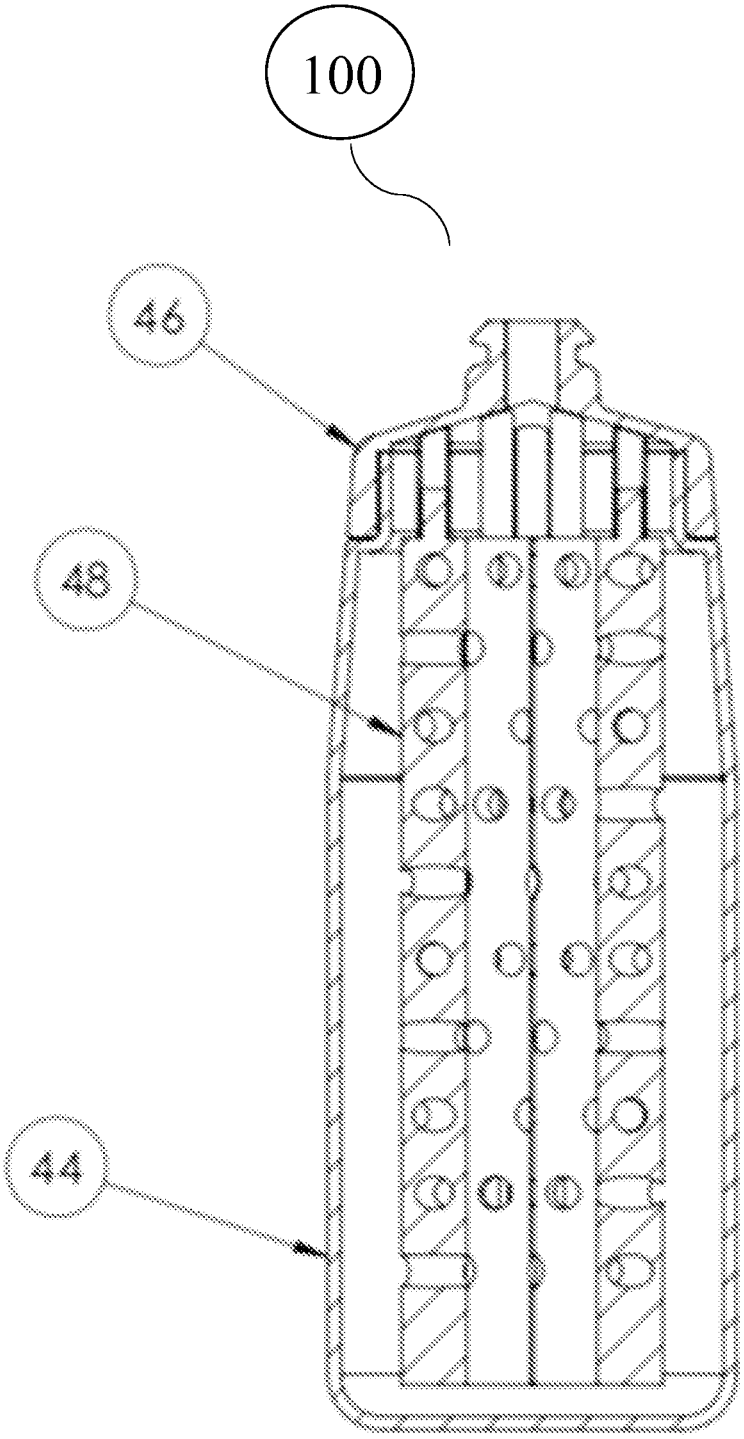
FIG. 2 illustrates a cross-sectional view of the anti-sloshing liquid-retaining bottle of FIG. 1.
Figure 3:
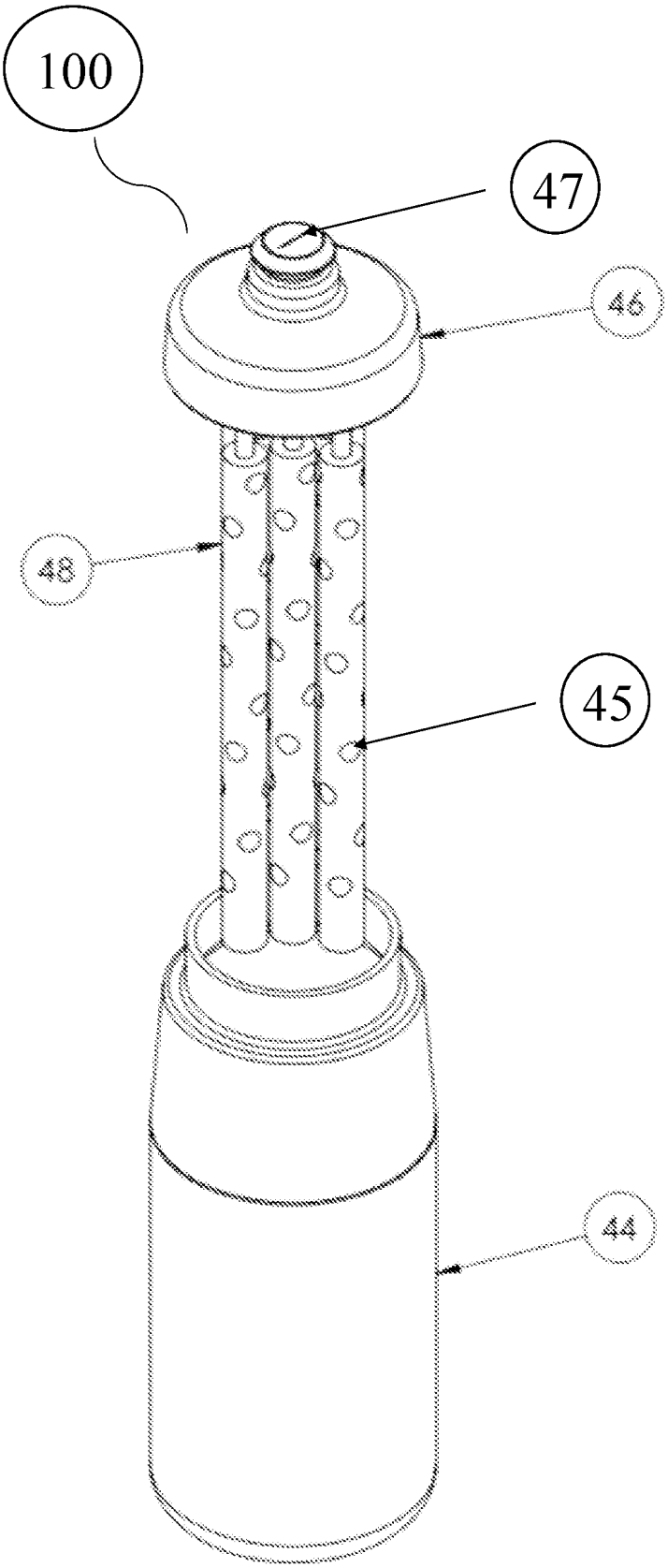
FIG. 3 illustrates an exploded view of the anti-sloshing liquid-retaining bottle of FIG. 1.

Turning now to FIGS. 1-3. FIGS. 1-3 illustrate one embodiment of an anti-sloshing liquid-retaining bottle 100 with a passive anti-sloshing mechanism. A passive anti-sloshing liquid-retaining bottle 100 includes lid 46, outer shell 44, one or more wave breakers 48, and mouthpiece 47. The one or more wave breakers 48 includes one or more or a plurality of apertures 45 so that when a liquid contained in outer shell 44 sloshes, the liquid passes through the apertures 45 of the one or more wave breakers 48 which are configured to disrupt the movement of the liquid. For example, as the liquid contacts the one or more wave breakers 48, the liquid trickles through the apertures 45 resulting in reduced sloshing and liquid movement. In some embodiments, the one or more wave breakers 48 include, additionally or alternatively, one or more grooves, indentations, cutouts, or the like that also act to disrupt movement of the liquid and reduce sloshing. For example, liquid entering the one or more grooves, indentations, or cutouts may swirl therein resulting in less energy and ultimately less sloshing.

The one or more wave breakers 48 may be reversibly couplable (e.g., via a snap fit connection, screw connection, etc.) to lid 46 or outer shell 44. In such embodiments, a number of wave breakers 48 may be optimized for a volume of liquid retained in the outer shell 44, for example more wave breakers 48 being used for less liquid (e.g., 2, 4. 6, 8, 10, 12, 14, 16, 18, 20 or more etc.). In other embodiments, the one or more wave breakers 48 and lid 46 or the one or more wave breakers 48 and outer shell 44 are a monolithic piece (i.e., one integrated component). Further, each wave breaker 48 may be of monolithic construction. Alternatively, each wave breaker 48 may include several sections coupled together to customize a length. For example, each section may be snapped into (e.g., each section includes a male peg end and a female port end), screwed into (e.g., each section includes a male helical screw end and a female threaded port), or otherwise attached to an adjacent section.

As shown in FIGS. 2-3, lid 46 couples to outer shell 44. For example, lid 46 is uncoupled from outer shell 44 to allow filling of outer shell 44 with a liquid. In such embodiments, outer shell 44 functions as a liquid-retaining compartment. Lid 46 is then coupled to outer shell 44 to retain the liquid therein. Lid 46 reversibly couples to outer shell 44 via one or more of a hinge mechanism, snap fit connection, screw and thread connection, or the like. In other embodiments, outer shell 44 is filled with liquid through a port, such that lid 46 is irreversibly coupled to outer shell 44. For example, mouthpiece 47 may be removable to allow filling of outer shell 44 with liquid.

FIGS. 4-20 illustrate various embodiments of anti-sloshing liquid-retaining bottles with active anti-sloshing mechanisms. The embodiments shown in FIGS. 4-20 use pressure, springs, or other active mechanisms to expand or restrict a bladder to reduce sloshing of a liquid in the bottle.

Turning now to FIGS. 4-11. FIGS. 4-11 illustrate various embodiments of anti-sloshing liquid-retaining bottles that use pressure to actively expand or contract a bladder. As will be appreciated by one of skill in the art, the anti-sloshing mechanisms depicted in FIGS. 4-20, while they employ active mechanisms, are implemented in different configurations.

FIGS. 4-11 illustrate an embodiment of an anti-sloshing liquid-retaining bottle 200 configured to use a pneumatic mechanism to apply compressive forces against a contained incompressible or nearly incompressible liquid retained within the anti-sloshing liquid-retaining bottle 200.

Figure 4:
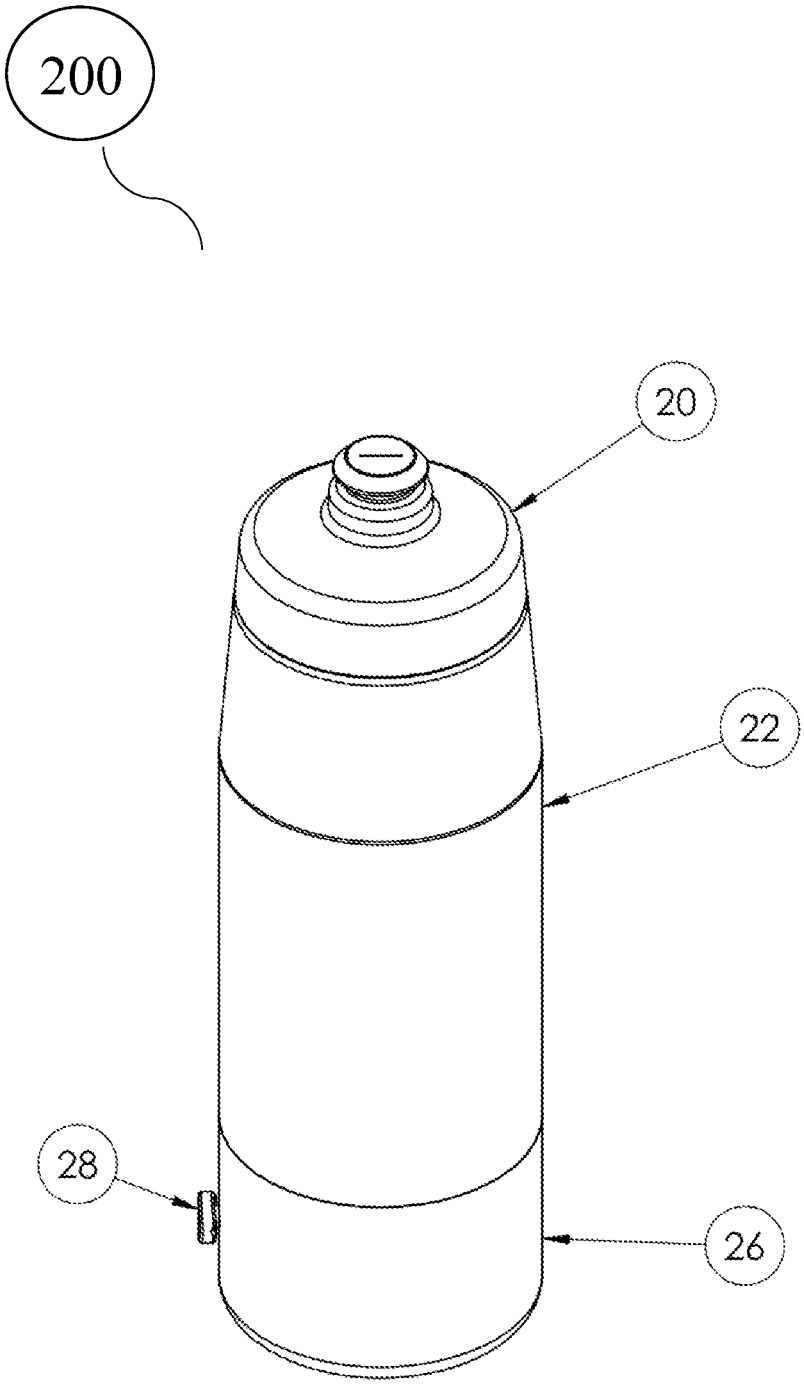
FIG. 4 illustrates another embodiment of an anti-sloshing liquid-retaining bottle.

FIG. 4 illustrates a front view of an embodiment of an anti-sloshing liquid-retaining bottle 200 with a pressure mechanism for preventing sloshing. The anti-sloshing liquid-retaining bottle 200 comprises a mouthpiece 23 configured to expel a non-carbonated liquid through mouthpiece 23. Anti-sloshing liquid-retaining bottle 200 comprises a lid 20, outer shell 22, a base comprising a high-pressure reservoir 26, and a depressible purge button 28 configured to open a release valve. The lid 20 is configured to reversibly couple to the outer shell 22 via one or more of a hinge mechanisms, snap fit connection, screw and thread connection, or the like. The lid 20 comprises a mouthpiece 23 with a means of controllably expelling liquid from the liquid retention compartment 25 including a bite valve or retractable nozzle or other nozzle configuration. In some embodiments, the outer shell 22 is filled with liquid through a port, such that the lid 20 is irreversibly coupled to the outer shell 22. For example, a mouthpiece 23 may be removable to allow filling of outer shell 22 with liquid.

Figure 5:
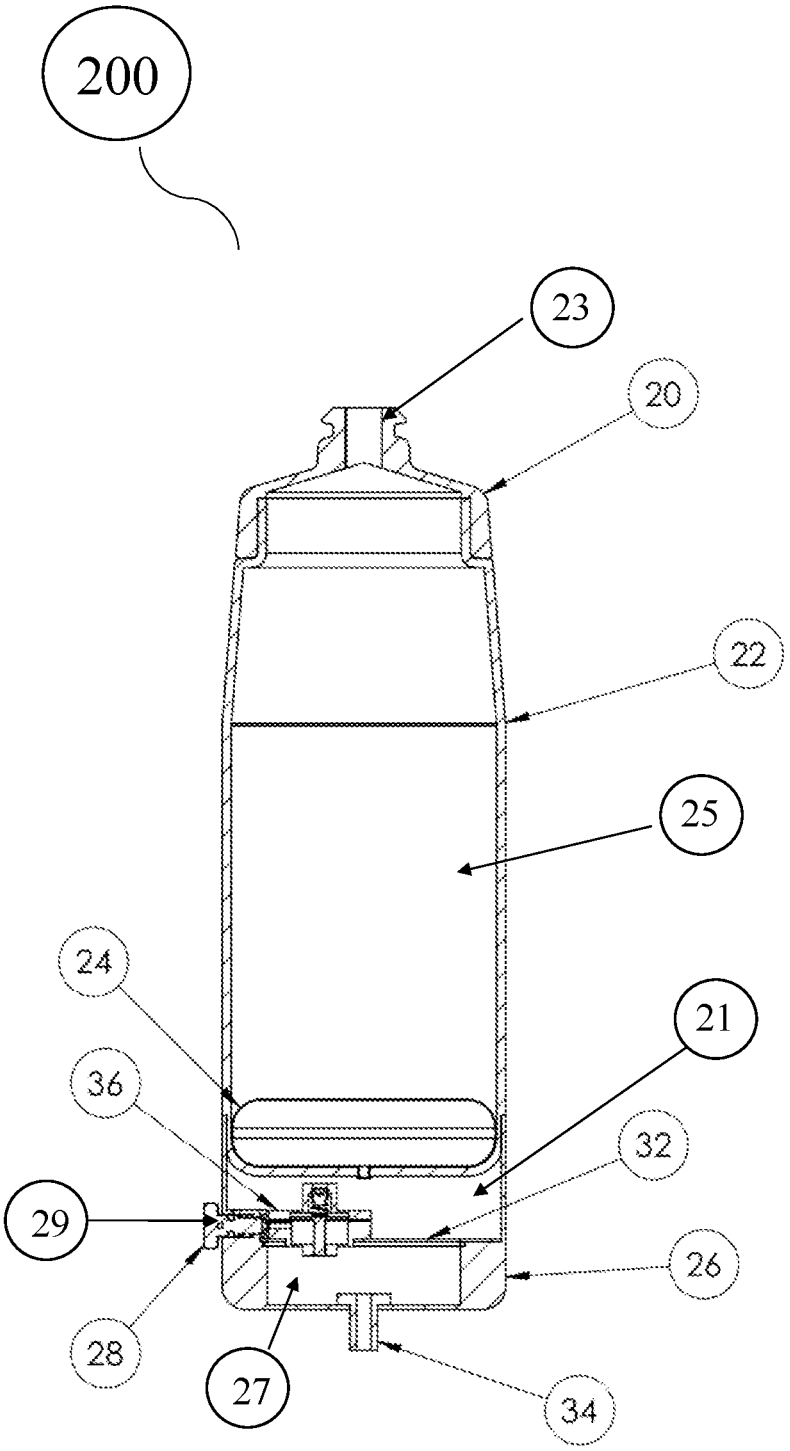
FIG. 5 illustrates a cross-sectional view of the anti-sloshing liquid-retaining bottle of FIG. 4, with the bladder in an unexpanded configuration.

FIG. 5 illustrates a cross-sectional view of a pneumatic anti-sloshing liquid-retaining bottle 200 with the air retention compartment 27 in the high-pressure reservoir 26 in a non-pressurized or inactive state. The anti-sloshing liquid-retaining bottle 200 comprises a bladder 24 and internal components including pressure regulator assembly 36, depressible purge button 28 for activating a purge or release valve 29, air retention compartment 27, Schrader or fill or presta valve 34 for pressurizing the air retention compartment 27 in the high-pressure reservoir 26, and pressure plate 32. The bladder 24 is fluidically coupled such that air from the high-pressure reservoir can be released by the regulator in the pressure regulator assembly 36 into a reduced pressure compartment 21 that is fluidically coupled to the bladder 24 allowing the bladder to expand against any liquid retained in the liquid retention compartment 25 of the bottle.

In various embodiments, a pneumatic anti-sloshing liquid-retaining bottle 200 can be filled by removing the lid 20 or the mouthpiece 23 from the outer shell 22 of the liquid-retaining bottle 200, for example when air retention compartment 27 in the high-pressure reservoir 26 is in a non-pressurized or inactive state and/or when the bladder 24 is collapsed, as illustrated in FIG. 5. The lid 20, mouthpiece 23, or other reversibly coupled component of the bottle may be removed (e.g. via one or more of a hinge mechanism, snap fit connection, screw and thread connection, etc.) from the outer shell 22, revealing an opening into the liquid retention compartment 25, formed by the outer shell 22 and the bladder 24. Filling of the liquid retention compartment 25 of the bottle may be done through the opening of the outer shell 22 after the lid 20, mouthpiece 23, or other reversibly coupled component of the bottle is removed for filling. After filling, the lid 20, mouthpiece 23, and/or other reversibly coupled component is replaced and coupled to the outer shell 22. In this filled state, the 10-24 oz. of supplied liquid (e.g., non-carbonated or carbonated liquid) is contained in an enclosed liquid retention compartment 25 formed by the lid 20, mouthpiece 23, outer shell 22, and bladder 24 of the anti-sloshing liquid-retaining bottle.

A filled pneumatic anti-sloshing liquid-retaining bottle 200 in an inactive or unpressurized state as shown in FIG. 5, can be activated for use by pressurizing the air retention compartment 27 housed within the high-pressure reservoir 26 before the bottle is filled with liquid, or before liquid is consumed from the bottle. Pressurization of the air retention compartment 27 is done by pumping air through a fill or Schrader or presta valve 34. The high-pressure reservoir 26 and the pressure plate 32 are configured to retain their shape under higher pressures (e.g. pressure in the range of 20-300 psi) against their surfaces. For example, the high-pressure reservoir 26 and/or the pressure plate 32 may include or be formed of aluminum, stainless steel, carbon fiber or other composites or like materials to retain its shape under pressure. Further, a thickness of a wall of the high-pressure reservoir 26 and/or pressure plate may be anywhere from 0.01 to 0.25 inches, 0.1 to 0.2 inches, 0.05 to 0.1 inches, 0.05 to 0.25 inches, 0.2 to 0.25 inches, etc. to retain its shape under pressure.

Air is forcefully pumped into the high-pressure reservoir 26 until the molecules of gas in the air are compressed enough to generate a pressure range of 20-300 psi. The increased pressure in the high-pressure reservoir generates a pressure differential across the pressure plate 32 and between the air retention compartment 27 and the reduced pressure compartment 21 that is fluidically coupled to bladder 24. This pressure differential is detected by the pressure regulator assembly 36 of the regulator, which is configured to regulate the pressure of the high-pressure reservoir down by a factor of 2-100 (e.g., 2, 5, 10, 15, 20, 25, 40, 45, 50, 60) to a low-pressure range of less than or equal to 20 psi (e.g., 1-5 psi, 2-5 psi, 2-8 psi, 2-10 psi, 15-20 psi, etc.). The bladder 24 is fluidically coupled to the reduced pressure compartment 21 on the lower pressure side of the pressure plate 32. A pressure in the reduced pressure compartment 21 may be 2-5 psi, 2-8 psi, 2-10 psi, 15-20 psi, etc. As the pressurized air is released into the reduced pressure compartment 21 from the air retention compartment 27 by the regulator in the pressure regulator assembly 36, the air molecules flow into the fluidically coupled region comprising the reduced pressure compartment 21 and the cavity of the bladder 24 causing the bladder 24 to expand. The bladder 24 is includes or is formed of a expandable material (e.g., silicon, silicone-based materials, elastic polymers, etc.) with a modulus configured to expand in response to changes in the air pressure of bladder 24 as well as retain a hydrostatic pressure or force against the liquid stored in the liquid retention compartment 25 and the walls of the outer shell 22, the lid 20, and the mouthpiece 23. The hydrostatic pressure or force prevents the liquid retained in the bottle from sloshing around. The pressurization of the compartment formed by the bladder 24 and the reduced pressure compartment 21 is generated and maintained by the high pressure of the air retention compartment 27 on the other side of the pressure plate 32, that has been regulated down by the regulator in the pressure regulator assembly 36 to a reduced pressure range of less than or equal to 60 psi. The low-pressure range is sufficient to inflate the bladder 24 and apply force to the exposed area (or pressure) to the surface of the liquid in the liquid retention compartment 25. A liquid that is incompressible or nearly incompressible stored within the bottle would retain or substantially retain a fixed volume under standard conditions (e.g., 32° F.-120° F. environmental temperature; atmospheric pressure (at anywhere from sea level to high mountains ~20,000 ft). Therefore, pressure applied by the inflation of the bladder 24 on the incompressible or substantially incompressible liquid against the fixed dimensions of the outer shell 22, the lid 20, the mouthpiece 23, and the expanding bladder 24, would eliminate the existence of air or space for the liquid to slosh around when liquid flow out of the mouthpiece 23 is constricted or stopped (e.g., via a bite valve, nipple valve, stop cock, etc.). When the mouthpiece 23 is open (e.g., via bite valve, nipple valve, stop cock, etc.), the liquid would be expelled from the liquid retention compartment 25 at a rate dependent on the rate at which the bladder 24 continuously expands; more specifically, at a rate that is determined by the low-pressure range established by the regulator in the regulator assembly, for example less than or equal to 60 psi (e.g., 2-5 psi, 2-8 psi, 2-10 psi, 15-20 psi, etc.). The pneumatic mechanism disclosed in this example provides both a convenient means of expelling the liquid from the bottle when the mouthpiece 23 is open, while also ensuring that the liquid is continuously retained between the bladder 24, the outer shell 22, lid 20, and mouthpiece 23 and thus unable to slosh around in the bottle.

Figure 6:
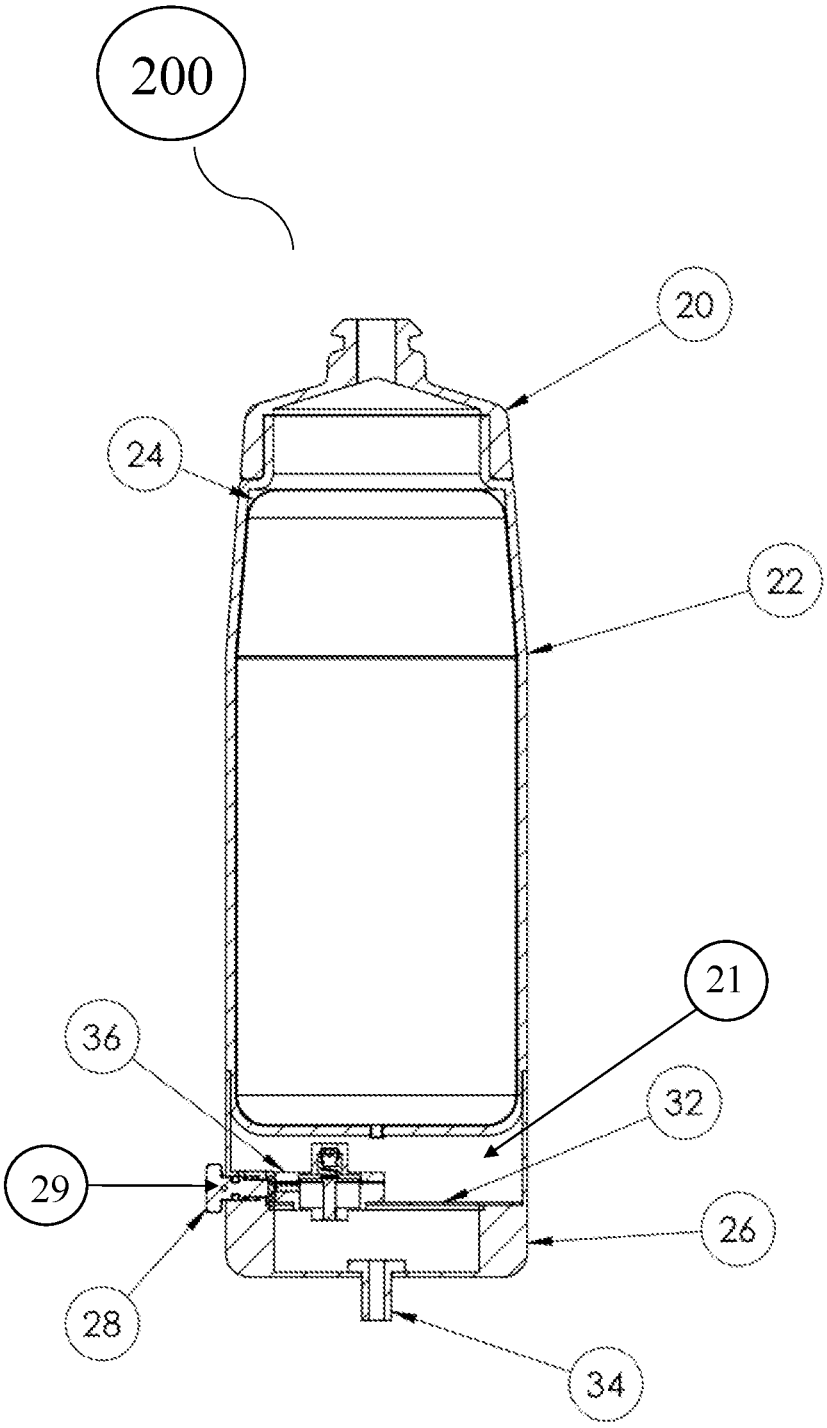
FIG. 6 illustrates a cross-sectional view of the anti-sloshing liquid-retaining bottle of FIG. 4, with the bladder in an expanded configuration.

FIG. 6 illustrates a cross-sectional view of an embodiment of the pneumatic anti-sloshing liquid-retaining bottle 200 with the bladder 24 fully expanded. In this embodiment, most or all of the volume of liquid stored in the liquid retention compartment 25 of FIG. 5 has been expelled through the mouthpiece 23 by the expansion of the bladder 24. The filling and emptying of the bottle 200 constitute one fill cycle. To refill the bottle after the first fill cycle, the purge button 28 is depressed activating a purge or release valve configured to vent the bladder into the atmosphere, such that the bladder 24 contracts back to an initial size (e.g., 0.2 cubic inches or less) of the bladder 24, for example as illustrated in FIG. 5. Depression of the purge button 28 simultaneously blocks off the output of the regulator in the pressure regulator assembly 36, thereby preventing the depressurization of the high-pressure reservoir 26 and retaining the high-pressure environment of the air retention compartment 27 while the bladder 24 is vented to the atmosphere (i.e., atmospheric pressure). In some embodiments the high-pressure reservoir 26 is configured to retain sufficient pressure in the high-pressure environment of the air retention compartment 27 to fill and use the bottle for additional fill cycles (e.g., a second, third, fourth, fifth, etc.) without requiring the high-pressure reservoir 26 to be reactivated or re-pressurized by pumping air forcefully (e g, manual or automatic mechanism; using a bike tire pump, high pressure bike shock pump, suction valve, or the like designed for reaching high pressure (e.g., >150 psi)) into the air retention compartment 27. The bottle 200 with an activated or pressurized air retention compartment 27 can then be refilled with liquid, for example using the mechanism that was used to fill the bottle during the first fill cycle. More specifically, the lid 20, mouthpiece 23, or other reversibly coupled component of the bottle 200 can be removed (e.g. via one or more of a hinge mechanisms, snap fit connection, screw and thread connection, etc.) from outer shell 22 revealing an opening into liquid retention compartment 25, formed, in part, by outer shell 22 and bladder 24. The liquid retention compartment 25 of the bottle is configured to be filled with liquid through the opening of the outer shell for example through a mouthpiece 23 or other reversibly coupled component of the bottle that can be removed for filling and replaced. In the filled state, the supplied liquid is contained in an enclosed liquid retention compartment 25 formed by the lid 20, mouthpiece 23, outer shell 22, and bladder 24 of the anti-sloshing liquid-retaining bottle 200.

Figure 7:
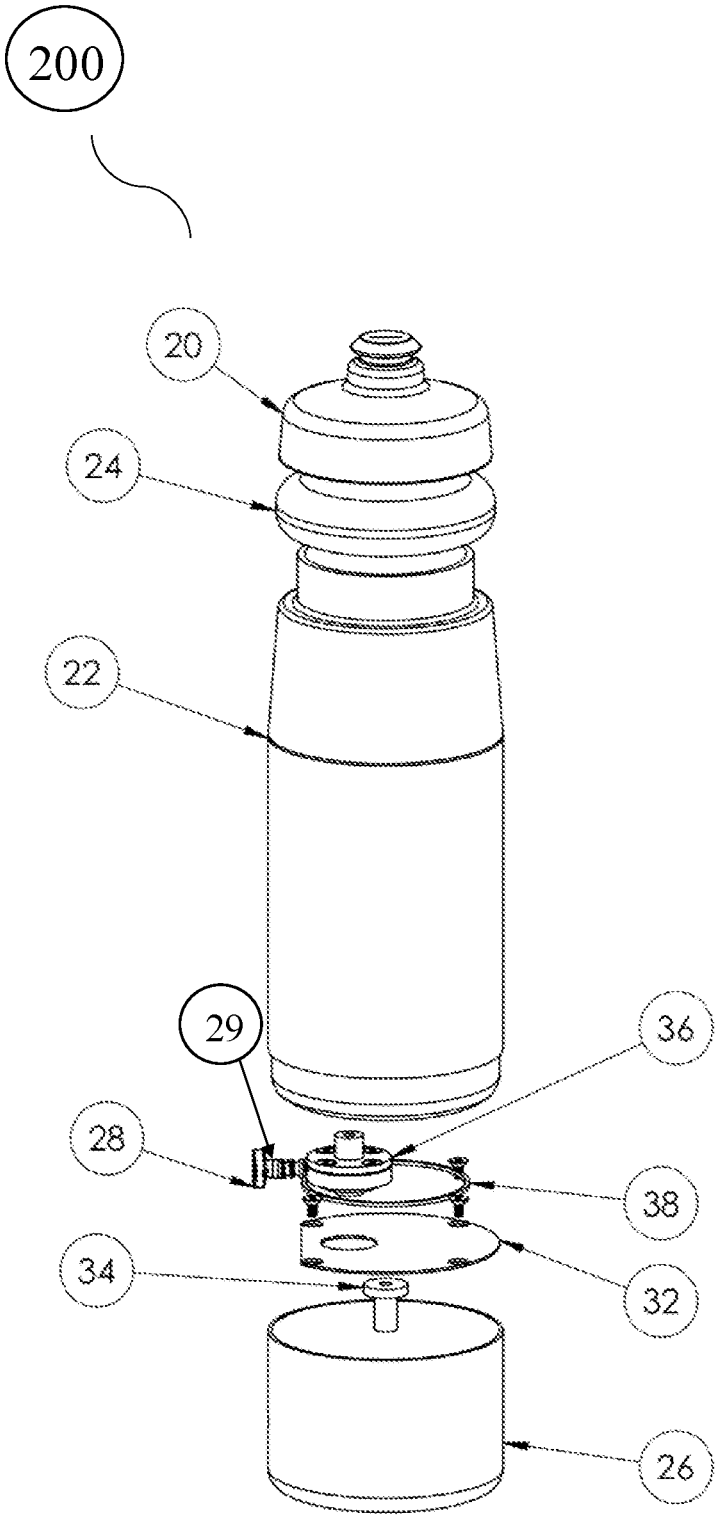
FIG. 7 illustrates an exploded view of the anti-sloshing liquid-retaining bottle of FIG. 4.

FIG. 7 illustrates an exploded view of an embodiment of bottle 200 in the depressurized or inactive state illustrated in FIG. 5. In this exploded view, the mechanisms forming the reduced pressure compartment 25 on the low-pressure side of the pressure plate 32 and the high-pressure reservoir 26 on the other side of the pressure plate 32 are illustrated in greater detail. The lid 20, bladder 24, and outer shell 22 are shown in the upper part of the exploded view, together these components form the liquid retention compartment 25, where the liquid is contained. Below this section of the device are the pressurized components of the liquid-retaining bottle. A pressure differential is formed across the pressure regulator assembly 36 and the pressure plate 32 that separate the reduced pressure compartment 21 and the air retention compartment 27. The regulator of the pressure regulator assembly 36 reduces the high-pressure provided by the air retention compartment 27 that was created by pumping air through the Schrader or fill or presta valve 34 into the air retention compartment 27 of the high-pressure reservoir 26. In this illustration, the purge seal 38 is visible below the pressure plate 32. The purge seal 38 (shown in FIGS. 8-11) is responsible for sealing the air retention compartment 27 of the high-pressure reservoir 26 off from the low-pressure side of the pressure plate 32 when the depressible button 28 activates the purge or release valve. This mechanism for purging is configured to release the pressure of the bladder 24 by depressing the purge button 28 and opening the purge valve while engaging the purge seal 38 to enable the anti-sloshing liquid-retaining bottle 200 to be used for multiple fill cycles without pumping up or re-pressurizing the air retention compartment 27 of the high-pressure reservoir 26 between the fill cycles.

Figure 8:
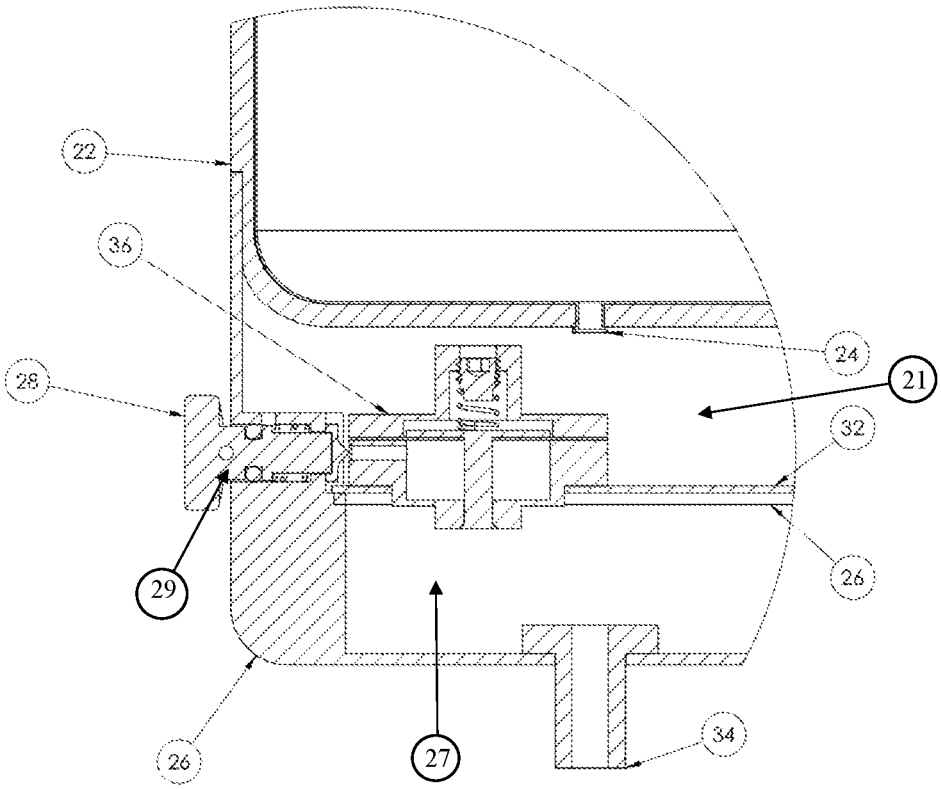
FIG. 8 illustrates a zoomed in, cross-sectional view of an embodiment of the mechanisms forming a low-pressure side of a pressure plate and a high-pressure reservoir of the anti-sloshing liquid-retaining bottle of FIG. 4.

FIG. 8 illustrates in greater detail an embodiment of the mechanisms forming the low-pressure side of the pressure plate 32 and the high-pressure reservoir 26. In this configuration the purge button 28 is in the default position, with the air in the bladder closed off to the atmosphere while also leaving the regulator open to fill the bladder 24. In this example, bottle 200 is illustrated in the pressurized or active state with the depressible button 28 configured for activating the purge or release valve 29 in the default state (e.g., protruding, or otherwise not activated, capable of being depressed, etc.). In this state, the purge seal 38 shown in FIG. 7 closes off the bladder 24 from the atmosphere (i.e., atmospheric pressure) thus creating a closed system between the regulator or the pressure regulator assembly 36 and the low-pressure side of the pressure plate 32. In this configuration, the bladder 25 is pressurized at a pressure range that is 1 psi to 10 psi (e.g., less than or equal to 10 psi, 20 psi, 5 psi, 1-5 psi, 60 psi, 2-5 psi, 10-30 psi, etc.) determined by the regulator, wherein the high-pressure side of the plate is determined by the pressure pumped into the high-pressure side. In some embodiments, the regulator is a diaphragm pressure regulator. In further embodiments, the output of pressure released by the regulator is directed towards the purge button 28 for release when the purge button 28 is depressed.

Figure 9:
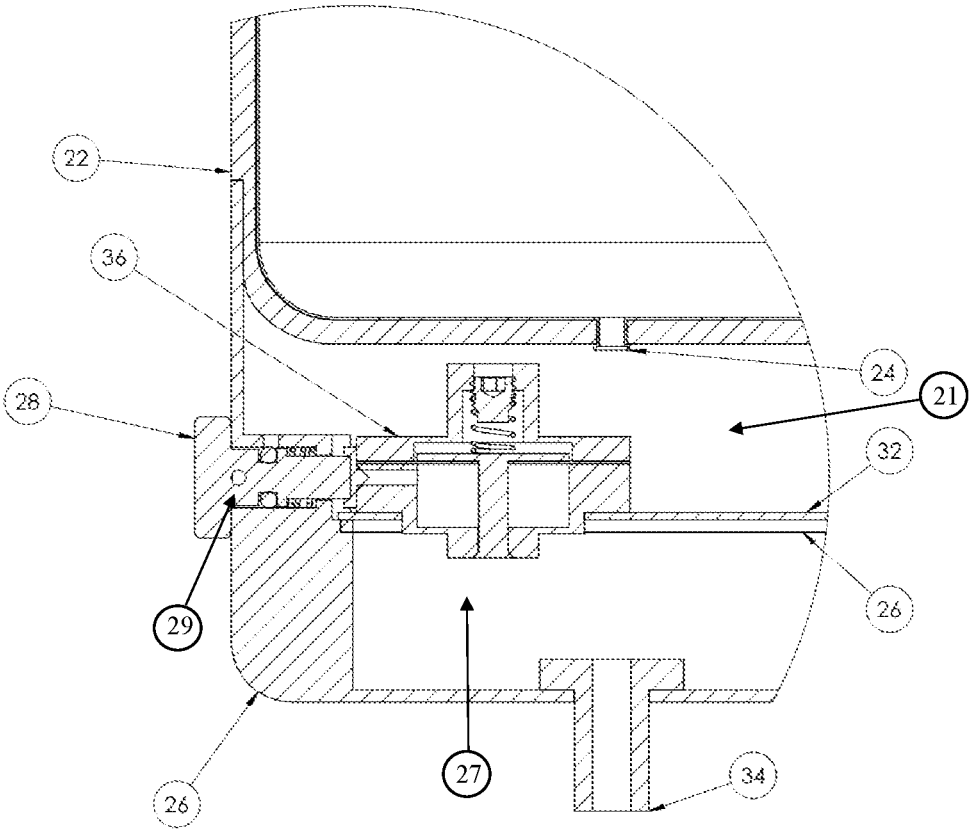
FIG. 9 illustrates a zoomed in, cross-sectional view of an embodiment of the anti-sloshing liquid-retaining bottle of FIG. 4 in a pressurized or active state with the purge button depressed into a purge position.

FIG. 9 illustrates an embodiment of the bottle 200 in a pressurized or active state with the purge button 28 depressed into the purge position, activating the purge or release valve and opening the bladder 24 to the atmosphere and deflating the bladder 24. Activating the purge or release valve simultaneously engages the purge seal 40 to close against the output on the regulator of the pressure regulator assembly 36 preventing the air retention compartment 27 within the high pressure reservoir 26 from venting to the atmosphere (i.e., releasing the pressurized air held within the air retention compartment 27 to the atmosphere).

Figure 10:
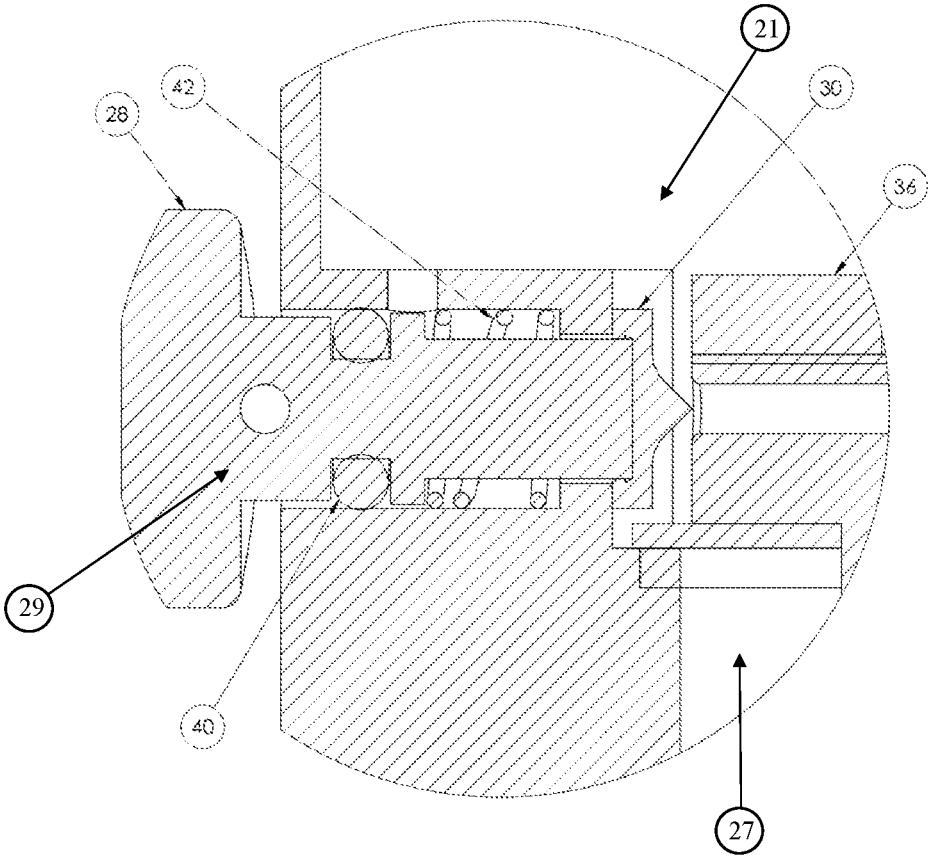
FIG. 10 illustrates another zoomed in, cross-sectional view of an embodiment of a purge mechanism of the anti-sloshing liquid-retaining bottle of FIG. 4.

FIG. 10 illustrates an embodiment of a purge mechanism of an anti-slosh liquid-retaining bottle 200 illustrated in FIGS. 5-10. As shown in FIG. 10, the purge button is in a default position that closes off the air in the bladder 24 to the atmosphere preventing the bladder 24 from purging while also leaving the regulator in the pressure regulator assembly 36 open and enabling the air from the air retention compartment 27 of the high pressure reservoir 26 to move through the regulator of the pressure regulatory assembly 36 allowing the filling of the bladder 24. As shown in FIG. 10, the purge button 28 for activating the purge or release valve is in a default or expressed position. In this illustration, the purge spring 42 keeps the purge button 40 in the default or expressed position. The regulator seal 30 is away from the regulator of the pressure regulator assembly 36 and the purge seal 40 attached to the purge button 28 is configured to allow the pressure regulator in the pressure regulator assembly 36 to flow in this state, thereby filling the bladder 24.

Figure 11:
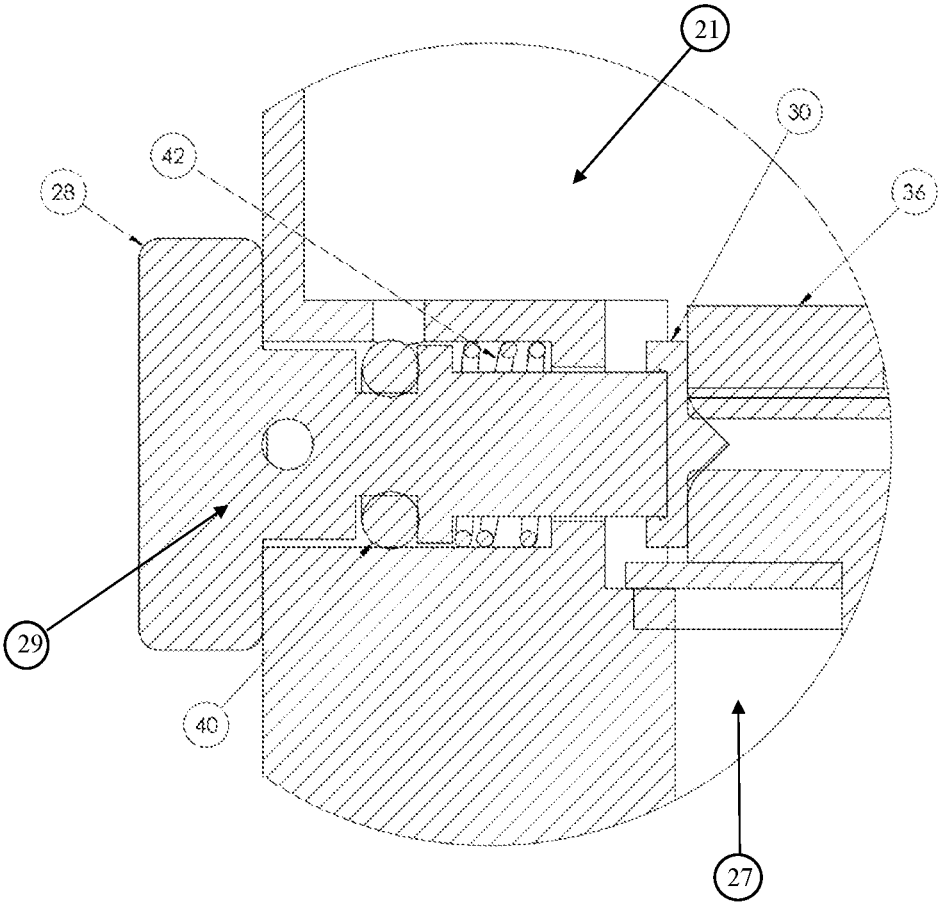
FIG. 11 illustrates another zoomed in, cross-sectional view of an embodiment of a purge mechanism of the anti-sloshing liquid-retaining bottle of FIG. 4.
Figure 12:
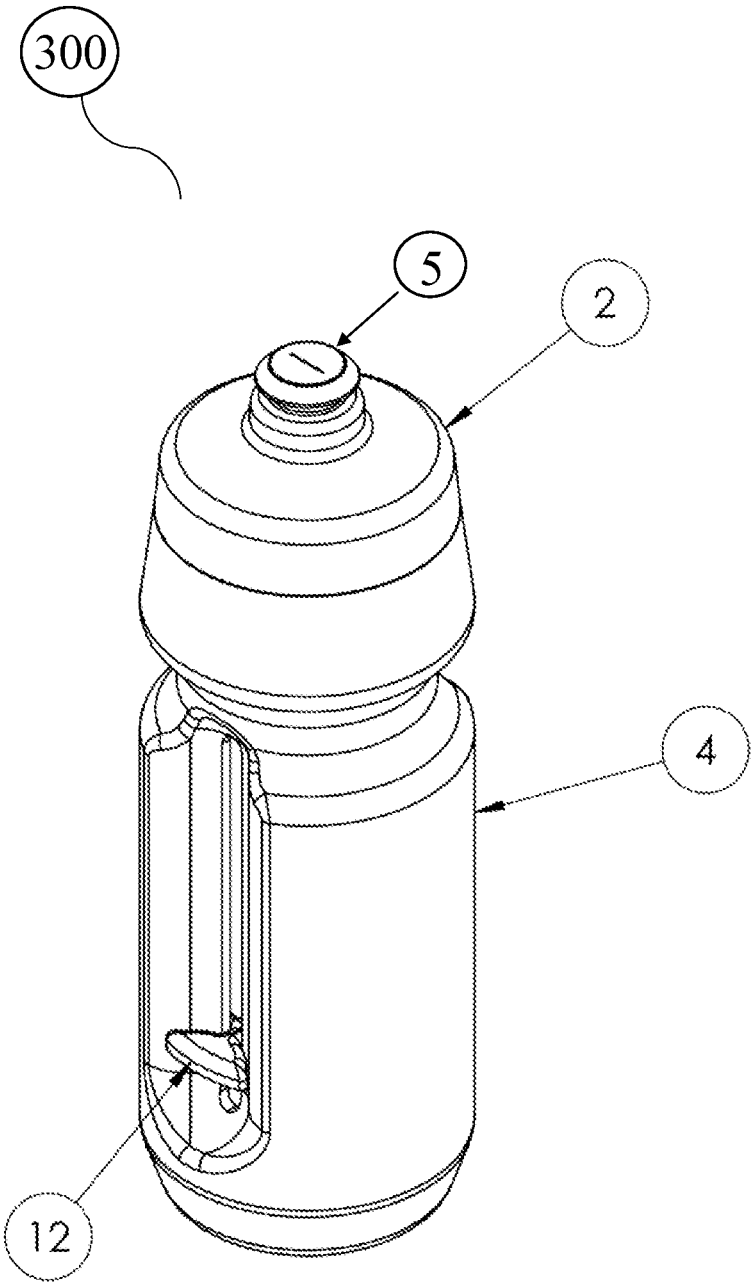
FIG. 12 illustrates another embodiment of an anti-sloshing liquid-retaining bottle.

FIG. 11 illustrates an embodiment of the purge mechanism of the anti-slosh bottle 200 illustrated in FIGS. 5-10 with the purge button in the purge position. The purge button in the purge position opens the air in the bladder 24 to the atmosphere, thereby deflating the bladder and simultaneously closing off the output port of the regulator in the pressure regulator assembly 36, so that the air retention compartment 27 in the high pressure reservoir 26 doesn't empty when purging the bladder 24. As shown in FIG. 11, the purge mechanism is in the purge position with the purge button 28 and purge spring 42 depressed. The purge seal 40, in this configuration, permits air from the bladder 24 to vent to the atmosphere while simultaneously activating the regulator seal 30 by moving it and pushing it into the regulator output of the pressure regulator assembly 36.

Turning now to FIGS. 12-20. FIGS. 12-20 illustrates various embodiments of an anti-sloshing liquid-retaining bottle that employs a spring-based anti-sloshing mechanism.

As shown in FIGS. 12-15, bottle 300 includes an anti-sloshing mechanism comprising a constant force spring mechanism. Bottle 300 shown in FIGS. 12-15 functions to expand or compress a bladder, configured to retain a liquid therein, using a spring mechanism that imparts a constant force on the bladder. In contrast to other embodiments described herein in which the outer shell retains a liquid in a liquid retaining compartment, the embodiment 300 shown in FIGS. 12-15 uses a bladder within an outer shell to retain a liquid. As such, in FIGS. 12-15 the bladder forms the liquid retaining compartment.

As shown in FIGS. 12-15, bottle 300 includes lid 2, outer shell 4, mouthpiece 5, bladder 6, and spring mechanism (depressible plunger 12, spring 8, spring housing 10, spring support 14, first retention mechanism 16, and second retention mechanism 18). Outer shell 4 retains bladder 6 and spring mechanism therein. Lid 2 is configured to reversibly couple to the outer shell 4 via one or more of a hinge mechanism, snap fit connection, screw and thread connection, or the like. Lid 2 includes a mouthpiece 5 with a means of controllably expelling liquid from the bladder, including a bite valve or retractable nozzle or other nozzle configuration. In some embodiments, the bladder 6 is reversibly coupled to lid 2, such that removal of lid 2 from outer shell 4 removes bladder 6 from outer shell 4 to allow bladder 6 to be filled with a liquid. As such, lid 2 and bladder 6 together define a liquid retention compartment. In other embodiments, bladder 6 is filled with liquid through a port, such that the lid 2 is irreversibly coupled to the outer shell 4. For example, a mouthpiece 5 may be removable to allow filling of bladder 6 with liquid.

Figure 13:
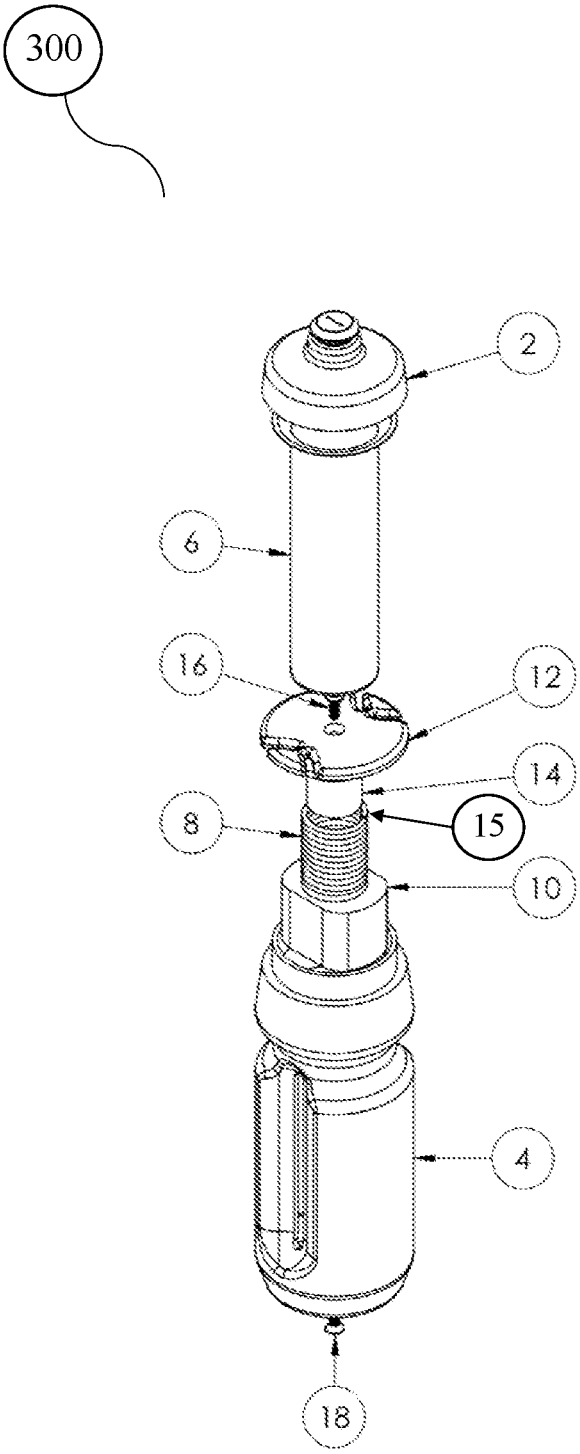
FIG. 13 illustrates an exploded view of the anti-sloshing liquid-retaining bottle of FIG. 12.

FIG. 13 shows an exploded view of an embodiment of an anti-sloshing liquid-retaining bottle 300 employing a constant force spring mechanism. The structure of the spring mechanism will now be described in greater detail with reference to FIG. 13. As shown in FIG. 13, spring 8 is movable or compressible within spring housing 10 between a compressed state, in which bladder 6 is filled with a liquid (FIG. 14), and an uncompressed state, in which some, part of, a quantity (e.g., ounces) of, or all of a liquid has been expelled from bladder 6 (FIG. 15). Further, as shown in FIG. 13, spring support 14 interacts with a proximal end 15 of spring 8 to maintain spring 8 substantially axially centered within spring housing 10. A protruding member of spring support 14 inserts into a center region of spring 8 to maintain spring 8 substantially axially centered within spring housing 10. Further, depressible plunger 12 is coupled to spring support 14 via retention mechanism 16, for example a screw, glue, peg, etc. As such, manipulation of depressible plunger 12 manipulates a position of spring 8. Retention mechanism 18, for example screw, glue, peg, etc., couples spring housing 10 to outer shell 4. Taken together, retention mechanism 18 maintains spring housing 10 in a substantially fixed position within outer shell 4.

Figure 14:
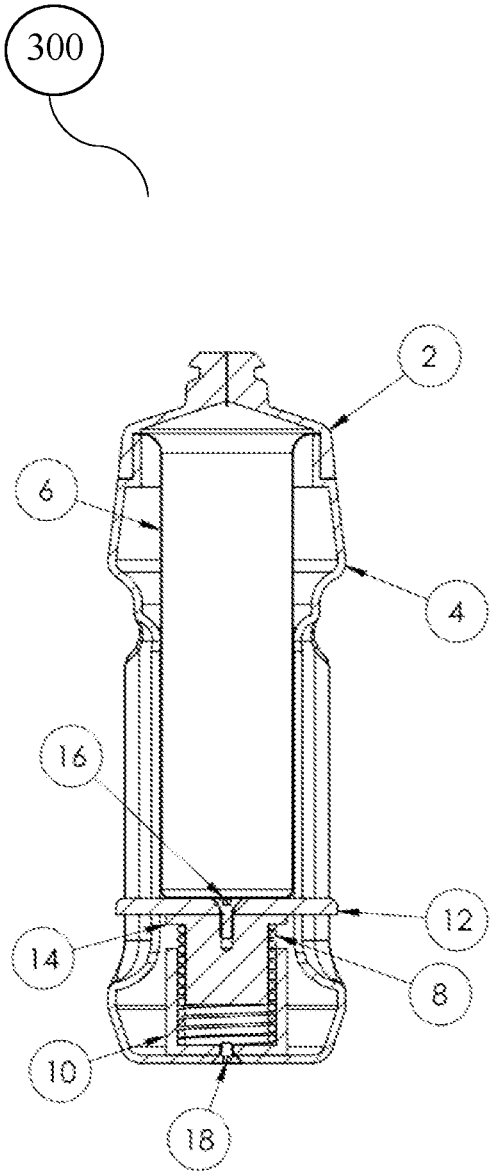
FIG. 14 illustrates a cross-sectional view of the anti-sloshing liquid-retaining bottle of FIG. 12, with the bladder in an expanded configuration.
Figure 15:
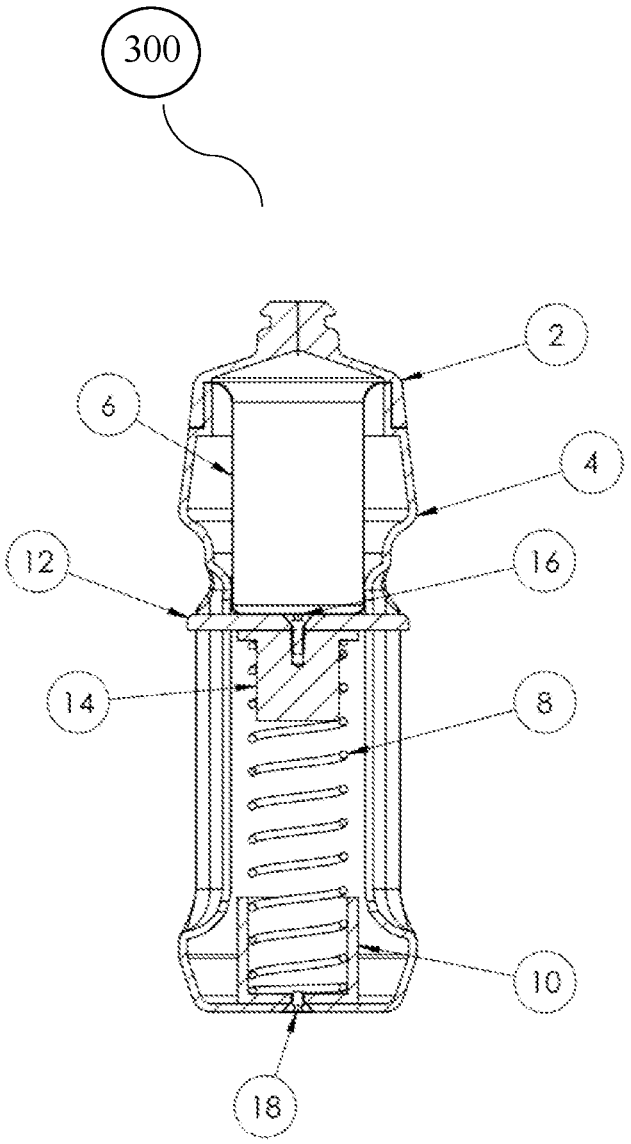
FIG. 15 illustrates a cross-sectional view of the anti-sloshing liquid-retaining bottle of FIG. 12, with the bladder in an unexpanded configuration.

FIGS. 14 and 15 show bladder 6 in an expanded configuration with a compressed spring mechanism and bladder 6 in a compressed configuration with a decompressed spring mechanism, respectively. As shown in FIG. 14, depressible plunger 12 compresses spring 8 to allow bladder 6 to expand. This expanded bladder configuration may also be referred to herein as a fill configuration, in which bladder 6 is full or substantially full of a liquid. Further, as shown in FIG. 15, depressible plunger 12 decompresses spring 8 and acts on bladder 6 to compress bladder 6, which compresses a liquid retained in bladder 6. As shown in FIG. 15, decompression of bladder 6 results in removal of air from bladder 6, compresses a liquid in bladder 6, and/or expels liquid from bladder 6 when mouthpiece 5 is open. The expansion (FIG. 15) or contraction (FIG. 14) of spring 8 is controlled by a position of depressible plunger 12. Depressible plunger 12 moves proximally (moved towards lid 2) as liquid is removed from the bladder, for example via a user drinking the liquid or liquid being expelled through a mouthpiece. As such, spring 8 applies a constant force onto bladder 6, so that as liquid is removed from bladder 6, a position of spring 8 is automatically adjusted to continually apply pressure to bladder 6. For example, 5-50 lbs. of force is applied to bladder 6 by spring 8. In some embodiments, the force applied to the bladder is 20 lbs, 25 lbs, 30 lbs, 35 lbs, 40 lbs, 20-40 lbs, 25-35 lbs, 30-35 lbs, 28-33 lbs, 29-31 lbs., 25-32 lbs., etc.

Figure 16:
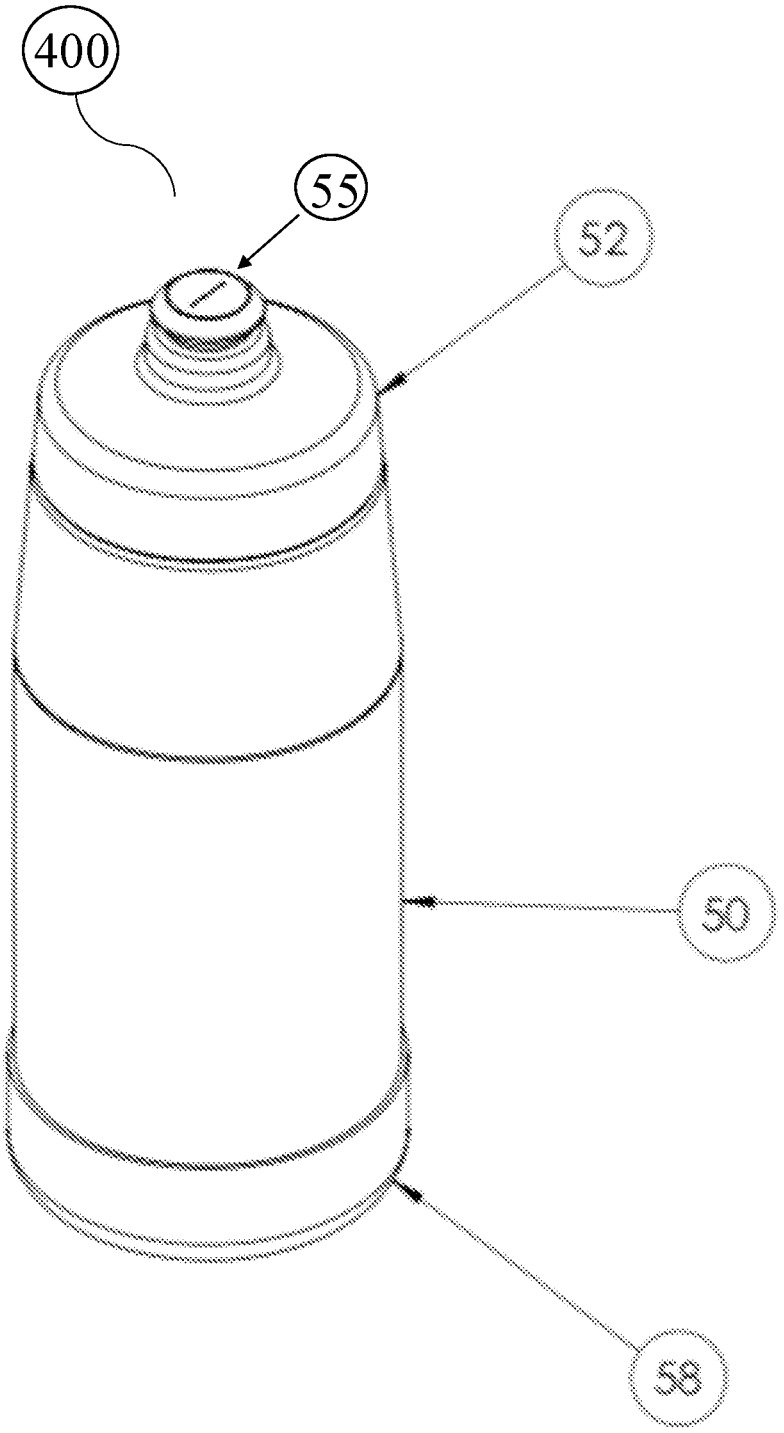
FIG. 16 illustrates a perspective view of another embodiment of an anti-sloshing liquid-retaining bottle.

Turning now to FIGS. 16-20. FIGS. 16-20 show an anti-sloshing liquid-retaining bottle 400 that includes a spring mechanism configured to expand a bladder to apply pressure to a liquid in a liquid retaining compartment. As shown in FIGS. 16-20, bottle 400 includes outer shell 50, lid 52, mouthpiece 55, liquid retention compartment 57, bladder 54, and spring mechanism (spring mount 58, spring housing 56, leaf springs 60). As shown in FIG. 16, lid 52 is configured to reversibly couple to the outer shell 50 via one or more of a hinge mechanism, snap fit connection, screw and thread connection, or the like. Lid 52 includes a mouthpiece 55 with a means of controllably expelling liquid from the liquid retention compartment, including a bite valve or retractable nozzle. In some embodiments, lid 52 is reversibly coupled to outer shell 50, such that removal of lid 52 from outer shell 50 allows liquid retention compartment 57 to be filled with a liquid. In other embodiments, liquid retention compartment 57 is filled with liquid through a port, such that the lid 52 is irreversibly coupled to the outer shell 50. For example, a mouthpiece 55 may be removable to allow filling of liquid retention compartment 57 with liquid.

Figure 17:
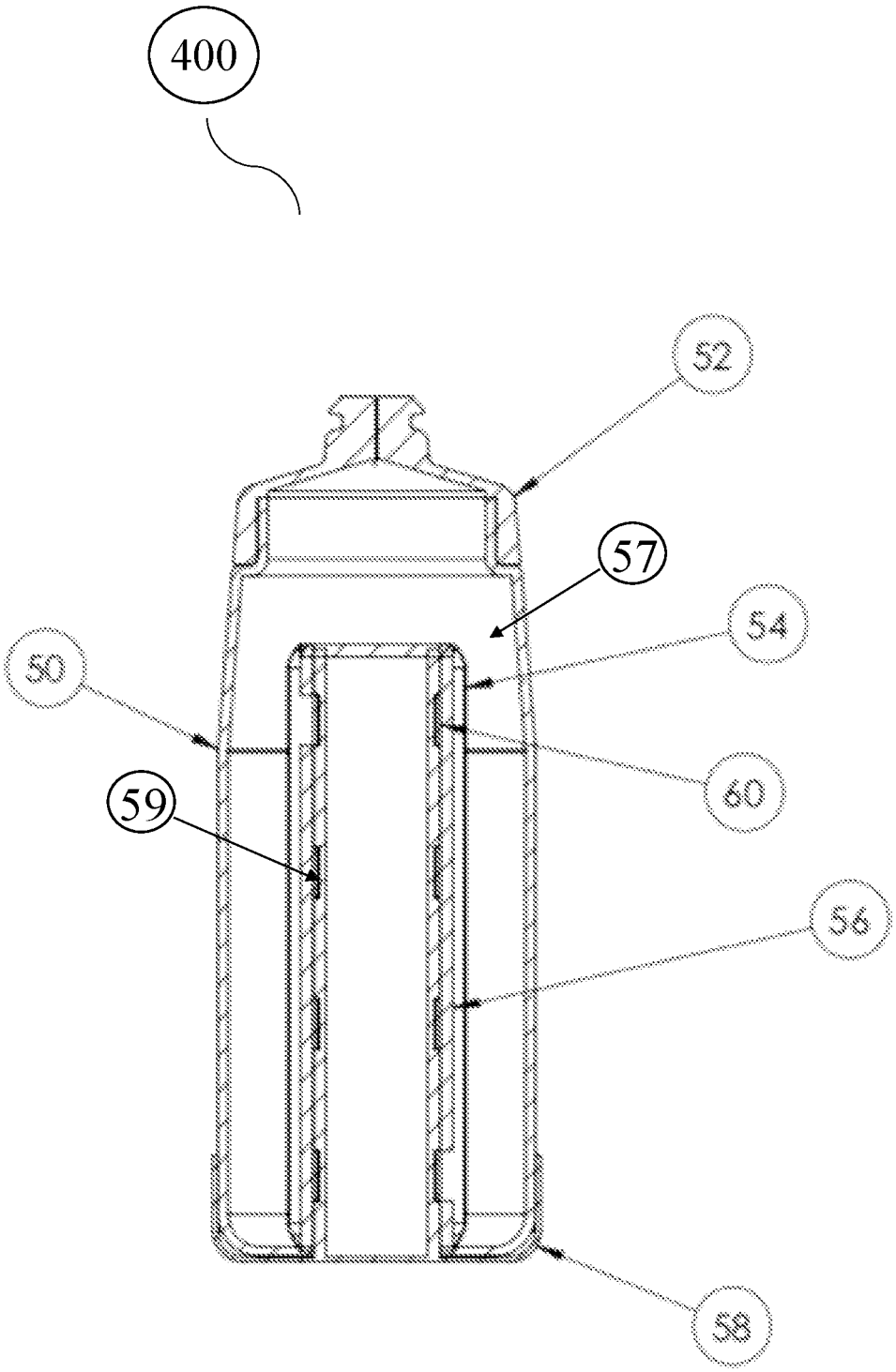
FIG. 17 illustrates a cross-sectional view of the anti-sloshing liquid-retaining bottle of FIG. 16, with the bladder in an unexpanded configuration.
Figure 18:
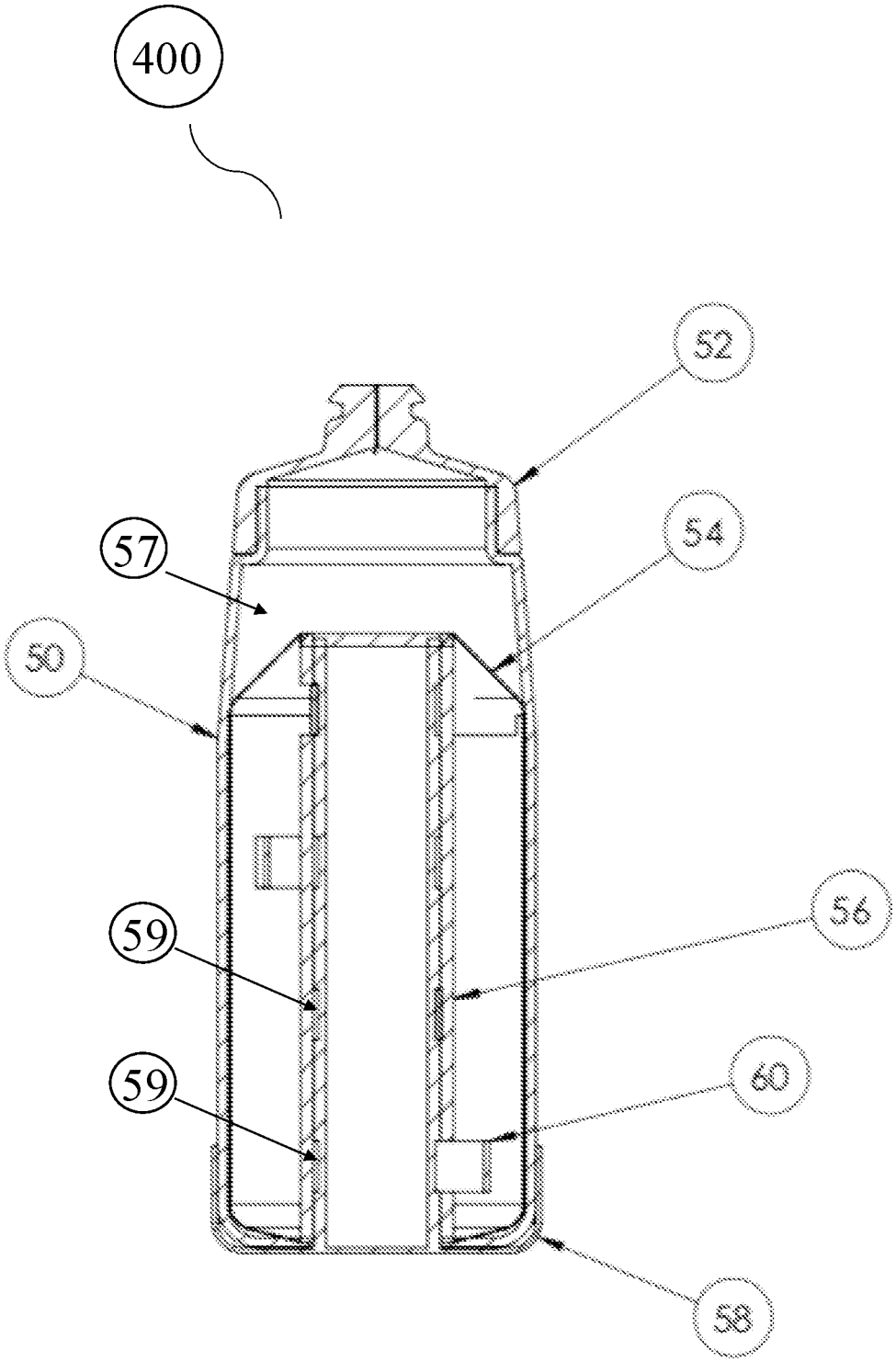
FIG. 18 illustrates a cross-sectional view of the anti-sloshing liquid-retaining bottle of FIG. 16, with the bladder in an expanded configuration.

As shown in FIGS. 17-18, liquid retention compartment 57 is defined by lid 52, outer shell 50, and bladder 54. In some embodiments, liquid retention compartment 57 is defined by lid 52, outer shell 50, and bladder 54 and/or spring housing 56.

Figure 19:
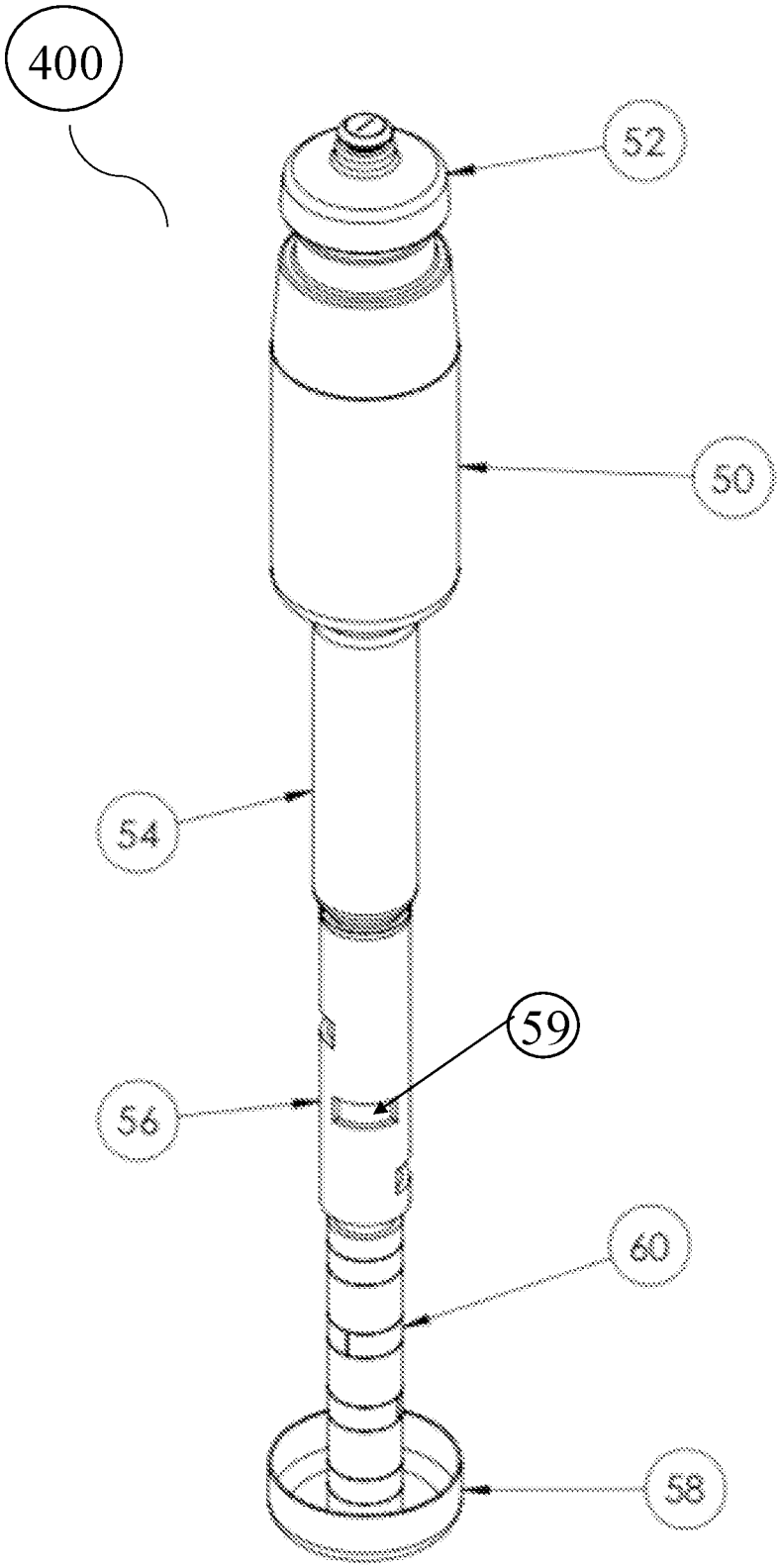
FIG. 19 illustrates an exploded view of the anti-sloshing liquid-retaining bottle of FIG. 16, with the leaf springs and bladder in an unexpanded configuration.
Figure 20:
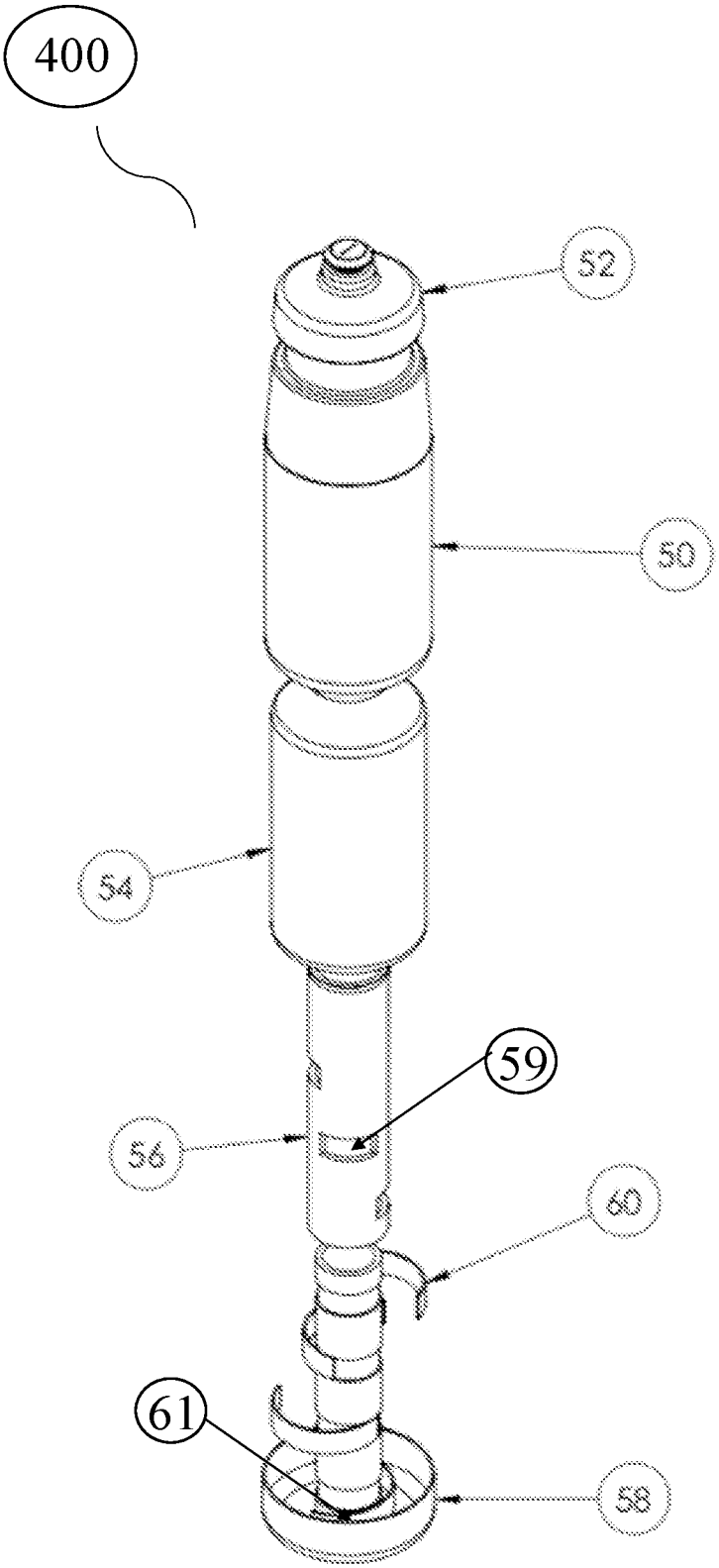
FIG. 20 illustrates an exploded view of the anti-sloshing liquid-retaining bottle of FIG. 16, with the leaf springs and bladder in an expanded configuration.

FIGS. 17-20 show various configurations of the spring mechanism, bladder 54, and liquid retention compartment 57 contained within outer shell 50. For example, FIGS. 17 and 19 show spring mechanism and bladder 54 in an unexpanded configuration, and FIGS. 18 and 20 show spring mechanism and bladder 54 in an expanded configuration. The structure of the spring mechanism will now be described in further detail.

Spring housing 56 is irreversibly or reversibly coupled to a distal end of outer shell 50 and maintains the spring mechanism substantially axially centered within outer shell 50. Further, bladder 54 is disposed about or positioned substantially around spring housing 56, as shown in FIGS. 17-18, so that extension of the leaf springs 60 expands bladder 54. Alternatively or additionally, bladder 54 is coupled to an interior surface of outer shell 50. The distal end of outer shell 50 forms a base or mount 58 of the spring mechanism. Each of the leaf springs are coupled to mount 58, which extends up into spring housing 56, as shown in FIGS. 19-20. Spring housing 56 further includes or defines one or more or a plurality of apertures or slots 59 through which a leaf spring 60 extends upon rotation of mount 58. As mount 58 is rotated, one or more leaf springs 60 expand from mount 58 and extend through one or more apertures in spring housing 56 to thereby expand bladder 54.

As shown in FIGS. 18 and 20, expansion of one or more leaf springs 60 causes bladder 54 to also expand, which applies pressure to a liquid in liquid-retaining compartment 57. In some embodiments, rotation of mount 58 causes a distal most leaf spring 61, as shown in FIG. 20, to expand first and then as mount 58 is further rotated, additional leaf springs 60 extend from mount 58, moving proximally toward lid 52, and through aperture 59 in spring housing 56. As such, a bladder 54 disposed around or about spring housing 56 is expanded distally first, and then expansion of the bladder 54 continues in a proximal direction towards lid 52 until all or substantially all liquid is expelled from liquid-retaining compartment 57.

To reset the bottle back to a fillable configuration in which liquid is added to liquid-retention compartment 57, as shown in FIGS. 17 and 19, spring mount 58 is rotated, in an opposite direction, so that leaf springs 60 retract and coil onto spring mount 58. In turn, bladder 54 returns to an unexpanded configuration.

Figure 21:
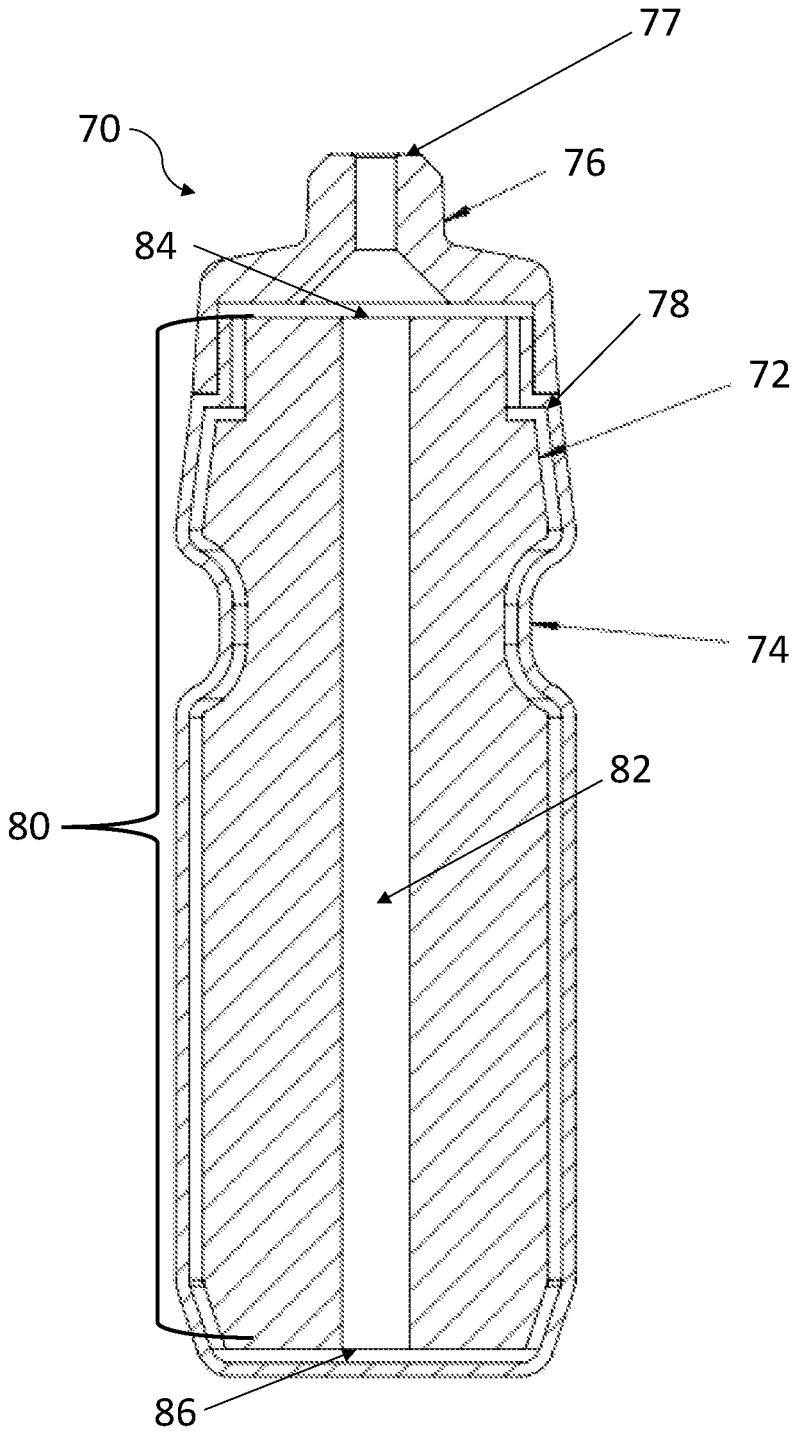
FIG. 21 illustrates a cross-sectional view of another embodiment of an anti-sloshing liquid-retaining bottle.
Figure 22:
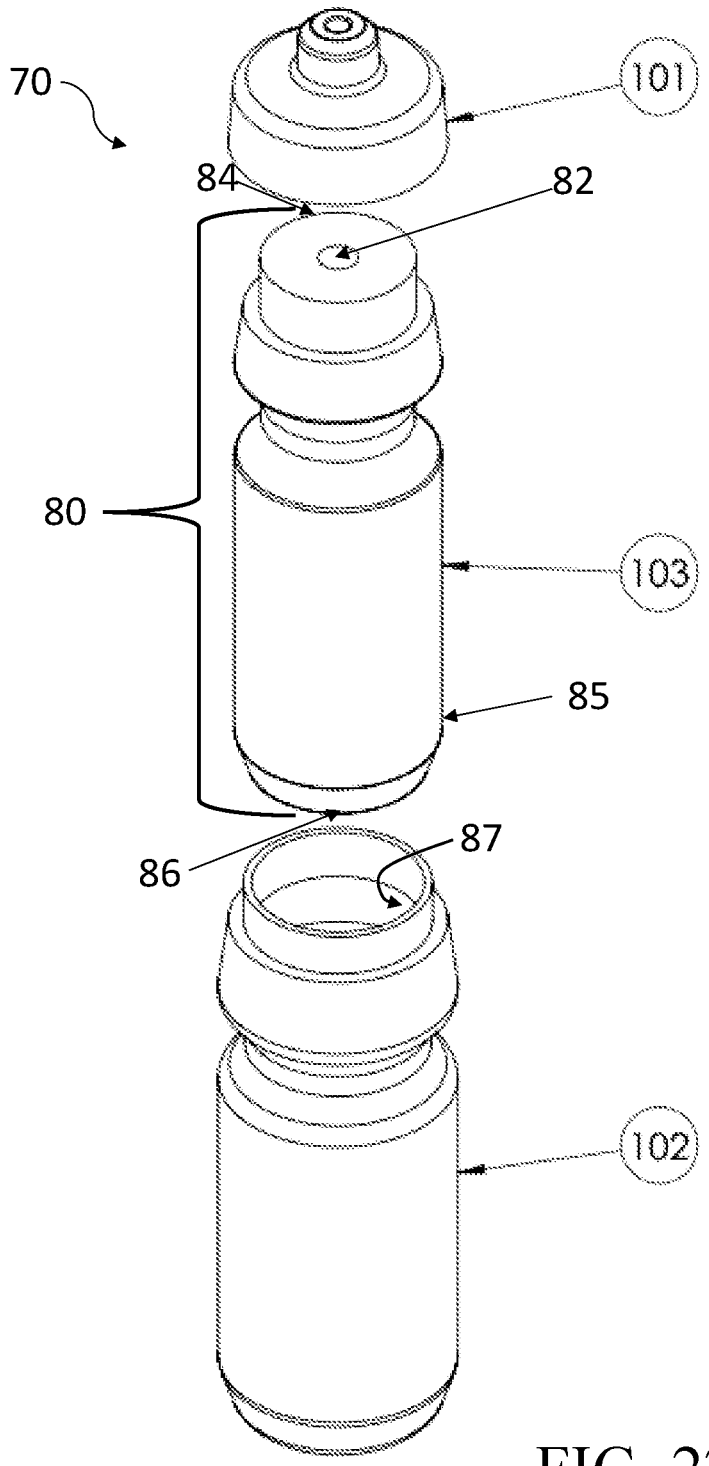
FIG. 22 illustrates an exploded view of an anti-sloshing liquid-retaining bottle of FIG. 21.
Figure 23:
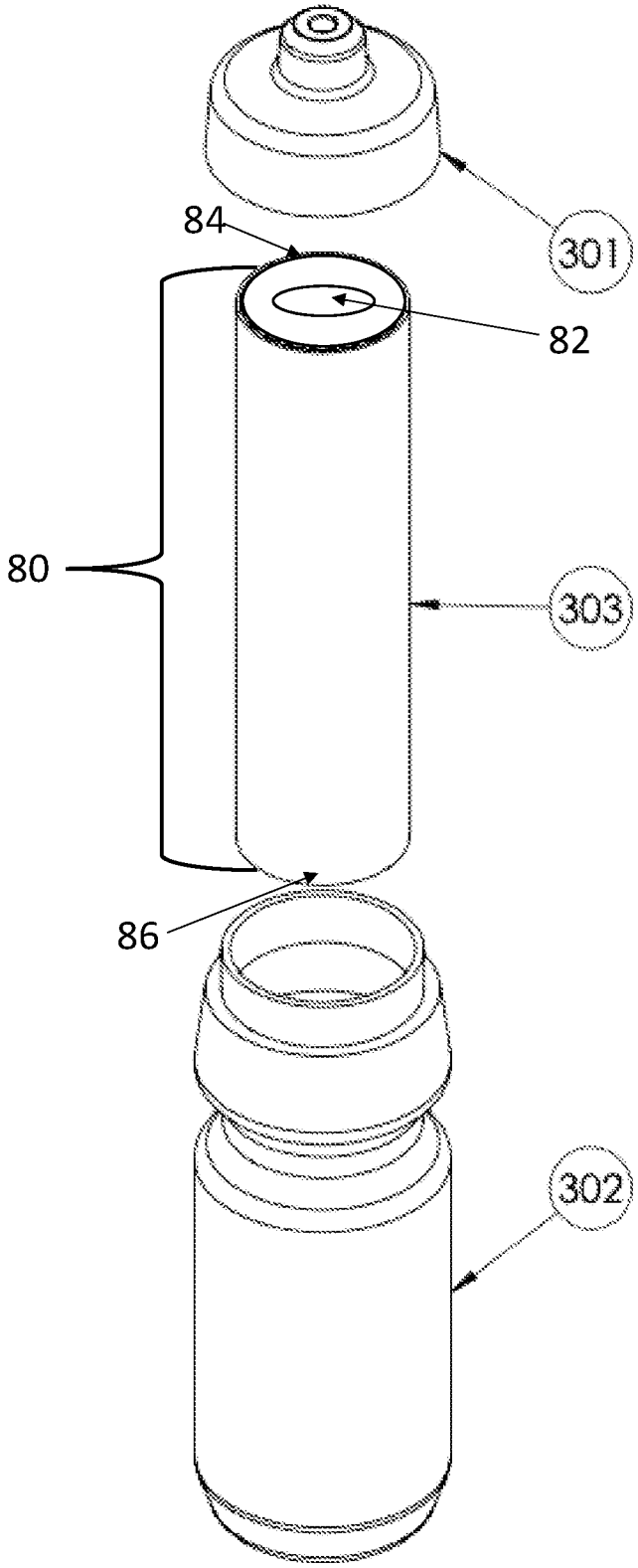
FIG. 23 illustrates an alternative insert for the anti-sloshing liquid-retaining bottle of FIG. 21.

FIGS. 21-23 illustrate various embodiments of an anti-sloshing liquid-retaining bottle 70. As shown in FIGS. 21-22, an anti-sloshing bottle 70 includes outer shell 74, 102 and lid 101, which together define a liquid retention compartment 78 configured for storing liquid therein. An insert 72, 103 may be positioned in the liquid retention compartment 78 of the outer shell 74. The insert 72 may be removable (i.e., can be taken out of and inserted into the outer shell), as shown in FIGS. 22-23, or integrally formed in the liquid retention compartment 78 (i.e., not removable), such that the insert 72 is fixed in the liquid retention compartment 78. For example, an outer surface 85 of the insert may be irreversibly attached to an inner sidewall or surface 87 of the outer shell 102, as shown in FIG. 22. The insert 72 may include an elongate body having one or more contours that mirror the contours of the outer shell, as shown in FIG. 22. Alternatively, the insert may include an elongate body having a substantially cylindrical shape, a tube shape, or any other suitable shape, as shown in FIG. 23. The elongate body 80 of insert 72 defines an aperture 82 that longitudinally extends through the elongate body 80 between a first end 84 and a second end 86 of the elongate body 80. Bottle 70 may further include a lid 76 and/or mouthpiece 77 through which a liquid is expelled, as shown in FIG. 21 and described elsewhere herein.

Figure 24:
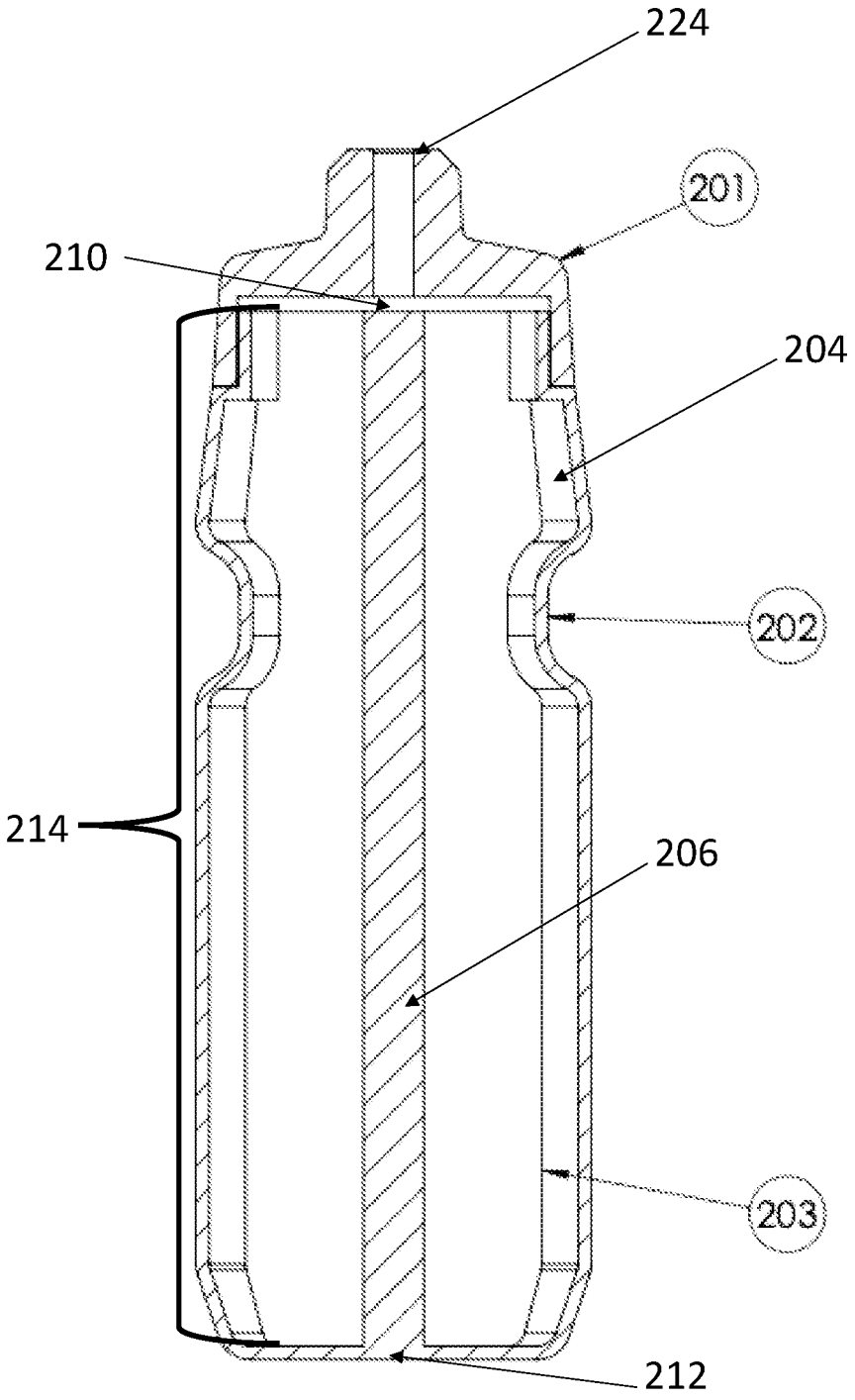
FIG. 24 illustrates a cross-sectional view of another embodiment of an anti-sloshing liquid-retaining bottle.
Figure 25:
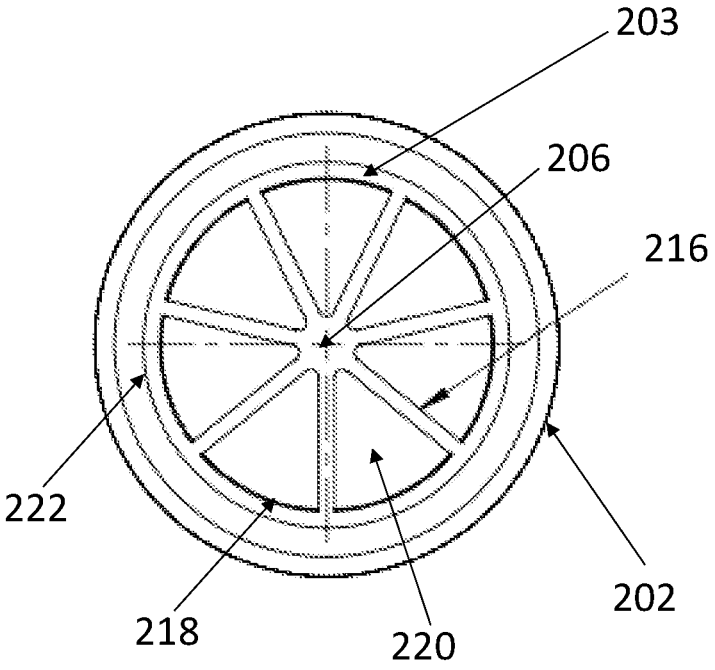
FIG. 25 illustrates a top view of the anti-sloshing liquid-retaining bottle of FIG. 24.

In some embodiments, as shown in FIGS. 24-25, the insert 203 positioned in the liquid retaining compartment 204 defined by the outer shell 202 and lid 201 further includes a hub 206. The hub 206 may longitudinally extend through a center of the aperture or may be offset from the center. For example, the offset may be less than or equal to half of the radius of the liquid retaining compartment. The hub 206 extends longitudinally through the aperture between the first 210 and second 212 ends of the elongate body 214. As shown in FIG. 25, one or more spokes 216 extend from hub 206 to an inner surface 218 of the elongate body 203 to tether the hub 206 to the elongate body 203. When inserted in the liquid retaining compartment 204, at least a portion of the outer surface 222 of the insert 203 contacts an inner surface of the outer shell. The spokes 216 segment the aperture 220 into equal portions or, in other embodiments, unequal portions. In some embodiments, there are an odd number of spokes, as shown in FIG. 25, for example 3, 5, 7, 9, 11, etc. In other embodiments, there are an even number of spokes, for example, 2, 4, 6, 8, 10, etc. In some embodiments, an optimal number of spokes may be determined based on a balance between sloshing reduction by the spokes and weight addition by the spokes. In at least one embodiment, a number of spokes does not exceed ten. In some embodiments of FIG. 24, the outer shell further includes a lid 201 and/or mouthpiece 224 through which liquid is expelled, as described elsewhere herein. Although wedge shaped apertures are shown in FIG. 25, one of skill in the art will appreciate that any aperture shape may be formed by the hub and spoke arrangement that is described, for example petal shaped apertures, rounded wedges, pyramid shaped apertures, etc.

Figure 26:
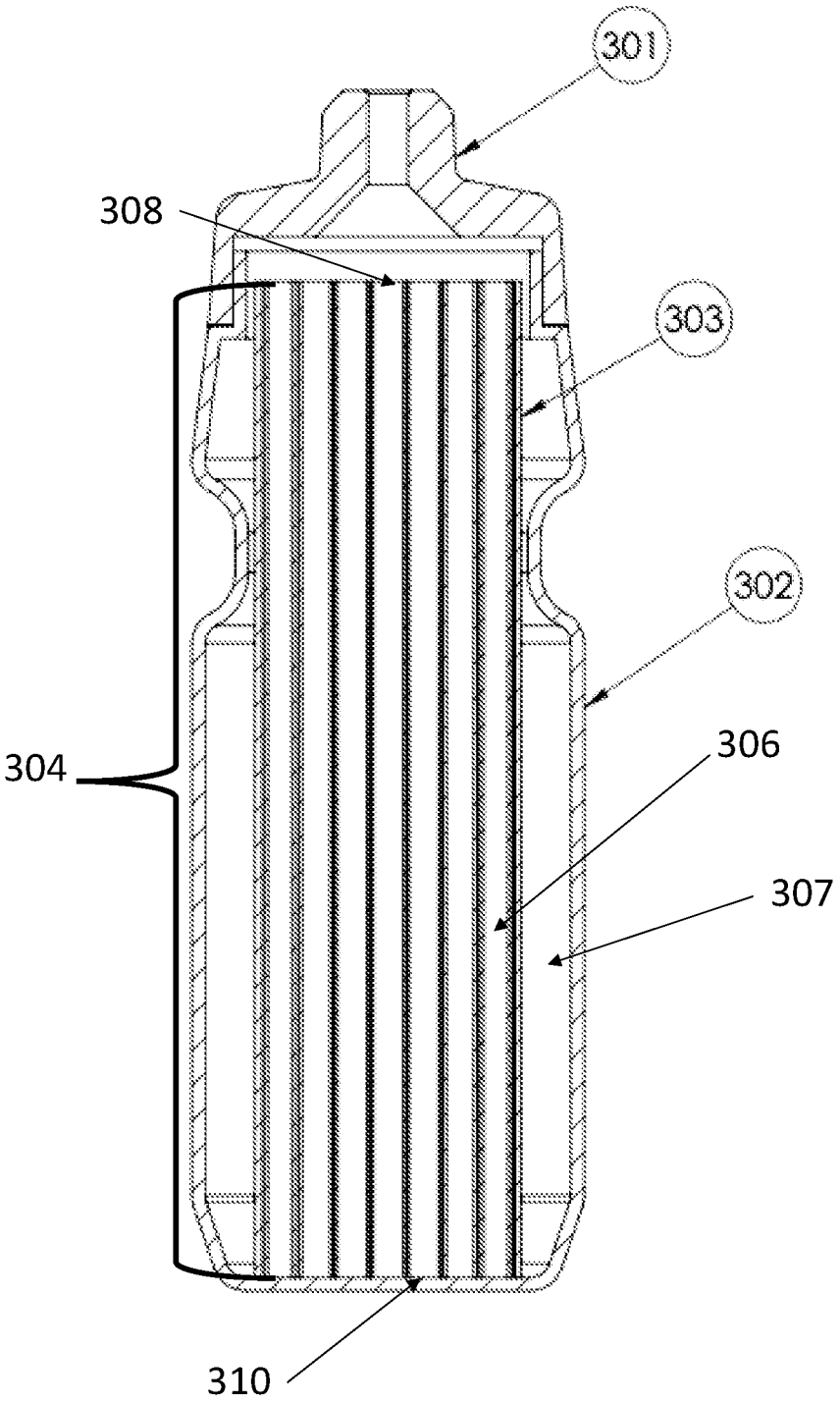
FIG. 26 illustrates a cross-sectional view of another embodiment of an anti-sloshing liquid-retaining bottle.
Figure 27:
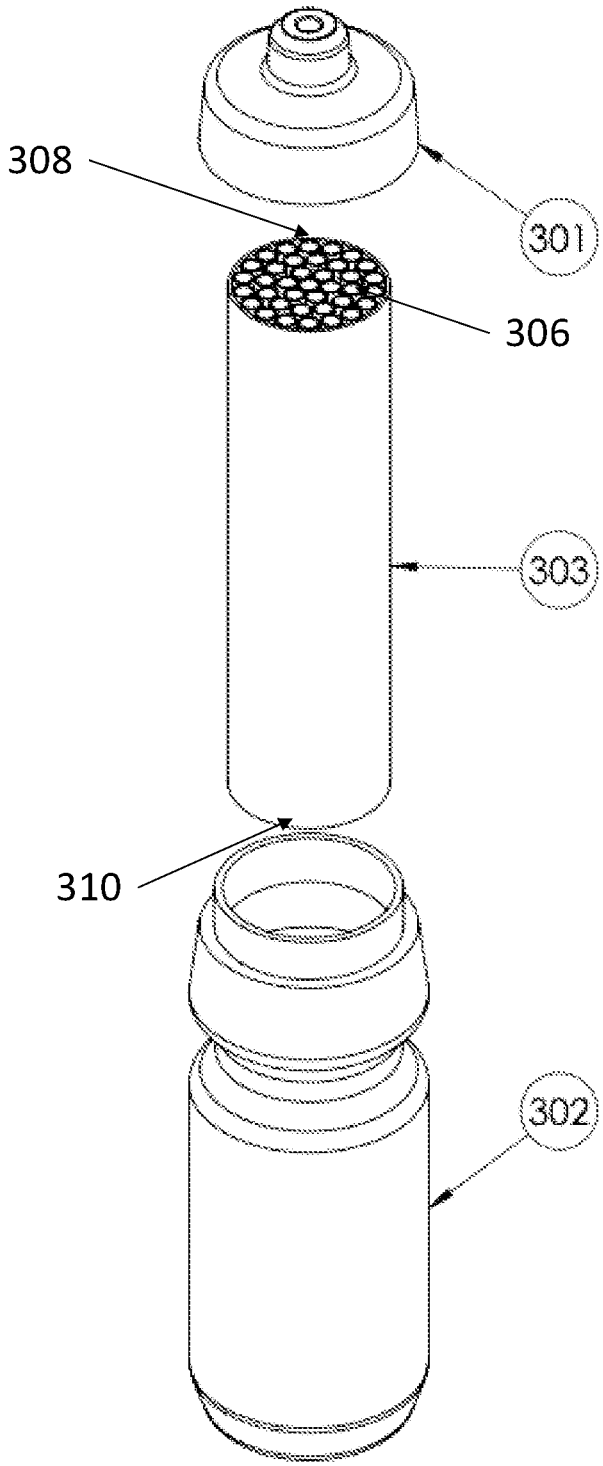
FIG. 27 illustrates an exploded view of the anti-sloshing liquid-retaining bottle of FIG. 26.
Figure 28:
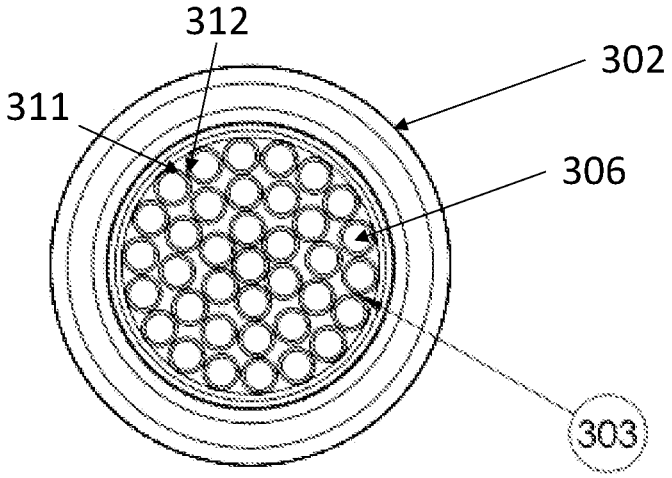
FIG. 28 illustrates a top view of the anti-sloshing liquid-retaining bottle of FIG. 26.

In some embodiments, as shown in FIGS. 26-28, the insert 303 positioned in the liquid retaining compartment 307 defined by the outer shell 302 and lid 301 includes elongate body 304 defining a plurality of apertures 306. The plurality of apertures 306 longitudinally extends through the elongate body 304 between the first end 308 and the second end 310. The plurality of apertures 306 may be uniform in size or, alternatively, have varying sizes. For example, the larger apertures may be positioned in a center region of the insert and smaller apertures may be positioned in an outer region of the insert. Alternatively, smaller apertures may be positioned in a center region of the insert and larger apertures may be positioned in an outer region of the insert. The apertures in the insert may be arranged concentrically, in parallel rows, in an unordered arrangement, or otherwise. For example, as shown in FIG. 28, the apertures are arranged substantially concentrically and are substantially uniform in size. In some embodiments, a diameter of each aperture may range from about 0.125 inches to about 1 inch; about 0.25 inches to about 1 inch; about 0.5 inches to about 1 inch; about 0.75 inches to about 1 inch; about 0.25 inches to about 0.75 inches; about 0.125 inches to about 0.875 inches; etc. A sidewall 311 of a first aperture may contact a sidewall 312 of an adjacent aperture. In some embodiments, a sidewall 311 of a first aperture may contact a sidewall of one or more adjacent apertures, two or more, or a plurality of apertures. Although circular apertures are shown in FIGS. 26-28, one of skill in the art will appreciate that any shape (e.g., ellipse, square, oval, etc.) of aperture may be used. The number of apertures extending through the elongate body may be about one to about 50; about five to about 45; about ten to about 40; about 30 to about 40; about 30 to about 50; about 40 to about 50 about 25 to about 50 about 20 to about 45; etc.

In any of the preceding embodiments, the lid is configured to reversibly couple to the outer shell via one or more of a hinge mechanisms, snap fit connection, screw and thread connection, or the like. The lid includes a mouthpiece with a means of controllably expelling liquid from the liquid retention compartment including a bite valve or retractable nozzle or other nozzle configuration. In some embodiments, the outer shell is filled with liquid through a port, such that the lid is irreversibly coupled to the outer shell. For example, a mouthpiece may be removable to allow filling of outer shell with liquid.

Figure 29:
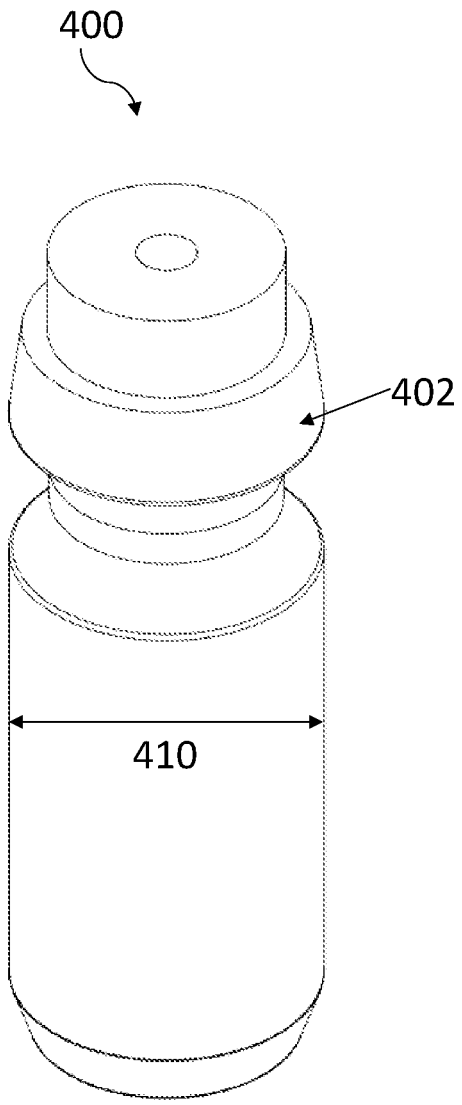
FIG. 29 illustrates one embodiment of an uncompressed state of an insert of an anti-sloshing liquid-retaining bottle.
Figure 30:
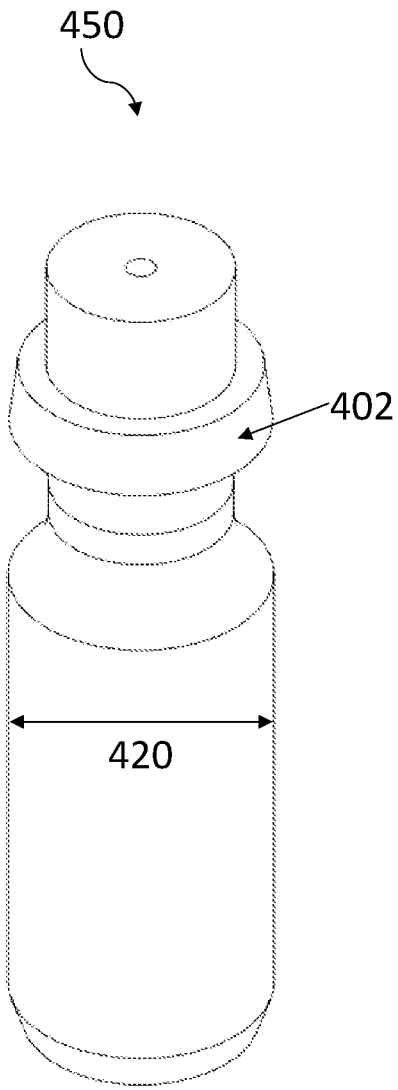
FIG. 30 illustrates one embodiment of a compressed state of an insert of an anti-sloshing liquid-retaining bottle.

In any of the embodiments of FIGS. 21-28, the insert (both removable and non-removable) may have any one or more of the following attributes:

a durometer between about 40 A and about 70 A, between about 45 A to about 65 A, between about 50 A to about 60 A, between about 40 A to about 60 A, between about 50 A to about 70 A, etc.;

a volume of less than about 10%, less than about 8%, less than about 6%, less than about 5%, less than about 2%, less than about 1%, between about 0.25% to about 1%, between about 1% and about 10%, between about 0.5% to about 1%, between about 0.5% to about 5%, etc. of a volume defined by the liquid retention compartment of the outer shell. For example, a volume of the insert may include a net volume such that the volume does not include any holes in the material of the insert or any aperture(s) defined by the insert. A gross volume of the insert includes all holes and/or apertures defined by the insert;

formed of or includes a mesh material comprising one or more of: open cell foam, closed cell foam, a stainless-steel mesh, an elastomeric waffle, a polyurethane mesh, a silicone mesh, a thermoelastic mesh, or a combination thereof;

prevents or reduces wave propagation through the liquid;

reduces or dissipates turbulence kinetic energy of the liquid;

formed of or includes a compressible mesh material;

an uncompressed state 400, as shown in FIG. 29, when removed from the outer shell and a compressed state 450, as shown in FIG. 30, when positioned in the outer shell;

a diameter 420 of a compressed state 450 of the insert 402 that is less than or equal to a smallest diameter of the liquid retention compartment of the outer shell, as shown in FIG. 30. For example, a diameter 420 of the compressed state 450 may be about 0.5 inches; about 0.25 inches to about 0.75 inches; about 0.5 inches to about one inch; etc. A diameter 410 of the uncompressed state 400 of the insert 402 may be substantially equal to a diameter of a liquid containing compartment, for example about 2 inches to about 5 inches; about 2.5 inches to about 4 inches; about 2.5 inches to about 3.5 inches; about 3 inches; etc., as shown in FIG. 29. In some embodiments, the compressed state 450 represents a semi-compressed state such that the insert 402 is maximally or fully compressed for insertion into the outer shell, but then partially or incrementally expands to fill the liquid retention compartment of the outer shell. In some embodiments, a diameter 420 of the compressed state 450 and/or a diameter 410 of in the uncompressed state 400 represents a maximum diameter of that state. In other embodiments, a diameter 420 of the compressed state 450 and/or a diameter 410 of in the uncompressed state 400 represents a minimum diameter of that state or an average diameter of that state. Although the embodiments in FIGS. 29-30 show an insert that is shaped similarly to an outer shell into which it is placed, one of skill in the art will recognize that any shape of insert is contemplated (e.g., cylindrical, rectangular, etc.);

a diameter 420 of a compressed state 450 of the insert 402 is about 2× to about 10×; about 2× to about 8×; about 4× to about 6×; about 5× to about 7×; etc. less than a diameter 410 of the uncompressed state 400 of the insert 402;

formed of or includes an antimicrobial material;

washable, for example in a washing machine, by hand, in a dishwasher, or otherwise; or a combination thereof.

In some embodiments, the insert may at least partially prevent wave propagation and/or sloshing of a liquid in the liquid retaining compartment defined by the outer shell. For example, the insert may at least partially absorb some of the liquid and/or at least partially disperse the water into separate cells or apertures to prevent larger volumes of water from moving in the compartment.

As used in the description and claims, the singular form "a", "an" and "the" include both singular and plural references unless the context clearly dictates otherwise. For example, the term "aperture" may include, and is contemplated to include, a plurality of apertures. At times, the claims and disclosure may include terms such as "a plurality," "one or more," or "at least one;" however, the absence of such terms is not intended to mean, and should not be interpreted to mean, that a plurality is not conceived.

The term "about" or "approximately," when used before a numerical designation or range (e.g., to define a length or pressure), indicates approximations which may vary by (+) or (−) 5%, 1% or 0.1%. All numerical ranges provided herein are inclusive of the stated start and end numbers. The term "substantially" indicates mostly (i.e., greater than 50%) or essentially all of a device, substance, or liquid.

As used herein, the term "comprising" or "comprises" is intended to mean that the devices include the recited elements and may additionally include any other elements. "Consisting essentially of" shall mean that the devices include the recited elements and exclude other elements of essential significance to the combination for the stated purpose. Thus, a device consisting essentially of the elements as defined herein would not exclude other materials or features that do not materially affect the basic and novel characteristic(s) of the claimed disclosure. "Consisting of" shall mean that the devices include the recited elements and exclude anything more than a trivial or inconsequential element. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. An anti-sloshing bottle, comprising:

an outer shell defining a liquid retention compartment configured for storing liquid; and a removable insert positionable in the liquid retention compartment of the outer shell, wherein the removable insert comprises an elongate body defining an aperture that longitudinally extends through the elongate body between a first end and a second end of the elongate body, wherein the removable insert has an uncompressed state when removed from the outer shell and a compressed state when positioned in the outer shell, wherein a diameter of the removable insert in the compressed state is less than or equal to a smallest diameter of the liquid retention compartment of the outer shell, wherein the removable insert has a durometer between about 40 A and about 70 A, wherein a volume of the removable insert is less than about 10% of a volume defined by the liquid retention compartment of the outer shell, and wherein the removable insert comprises a compressible mesh material.

2. The anti-sloshing bottle of claim 1, wherein the volume of the removable insert is less than about 1% of the volume defined by the outer shell.

3. The anti-sloshing bottle of claim 1, wherein the compressible mesh material is selected from the group consisting of: a stainless-steel mesh, an elastomeric waffle, an open cell foam, a closed cell foam, a polyurethane mesh, a silicone mesh, a thermoelastic mesh, or a combination thereof.

4. The anti-sloshing bottle of claim 1, wherein the diameter of the removable insert in the compressed state is about 0.25 inches to about 1 inch.

5. The anti-sloshing bottle of claim 1, wherein the elongate body defines a plurality of apertures that longitudinally extend through the elongate body between the first end and the second end.

6. The anti-sloshing bottle of claim 1, further comprising a mouthpiece movable between an open configuration and a closed configuration, such that in the open configuration, the mouthpiece is configured to expel the liquid.

7. The anti-sloshing bottle of claim 1, wherein the removable insert prevents wave propagation through the liquid.

8. The anti-sloshing bottle of claim 1, wherein the removable insert comprises or is formed of an antimicrobial material.

9. The anti-sloshing bottle of claim 1, wherein a hub extends longitudinally through the aperture between the first and second ends of the elongate body, and wherein one or more spokes extend from the hub to an internal surface of the elongate body to tether the hub to the elongate body.

10. The anti-sloshing bottle of claim 9, further comprising an odd number of spokes.

11. The anti-sloshing bottle of claim 9, further comprising an even number of spokes.

12. A removable insert for reducing sloshing in a bottle, comprising:

an elongate body extending between a first end opposite a second end; and an aperture defined by the elongate body and extending longitudinally through the elongate body between the first and second ends, wherein the elongate body has an uncompressed state when removed from an outer shell and a compressed state when positioned in the outer shell, wherein a diameter of the elongate body in the compressed state is less than or equal to a smallest diameter of a liquid retention compartment defined by the outer shell, wherein the removable insert has a durometer between about 40 A and about 70 A, wherein a volume of the removable insert is less than about 10% of a volume defined by the outer shell, and wherein the removable insert comprises a compressible mesh material.

13. The removable insert of claim 12, further comprising the outer shell defining the liquid retention compartment configured for storing liquid.

14. The removable insert of claim 12, wherein the volume of the removable insert is less than about 1% of the volume defined by the outer shell.

15. The removable insert of claim 12, wherein the compressible mesh material is selected from the group consisting of: a stainless-steel mesh, an elastomeric waffle, an open cell foam, a polyurethane mesh, a silicone mesh, a thermoelastic mesh, or a combination thereof.

16. The removable insert of claim 12, wherein the diameter of the removable insert in the compressed state is about 0.25 inches to about 1 inch.

17. The removable insert of claim 12, wherein the elongate body defines a plurality of apertures that longitudinally extend through the elongate body between the first end and the second end.

18. The removable insert of claim 12, wherein the removable insert prevents wave propagation through the liquid.

19. The removable insert of claim 12, wherein a hub extends longitudinally through the aperture between the first and second ends of the elongate body, and wherein one or more spokes extend from the hub to an internal surface of the elongate body to tether the hub to the elongate body.

20. An anti-sloshing bottle, comprising:

an outer shell defining a liquid retention compartment configured for storing liquid; and an insert comprising an elongate body defining an aperture that longitudinally extends through the elongate body between a first end and a second end of the elongate body, wherein an outer surface of the insert is irreversibly attached to an inner sidewall of the outer shell, wherein the insert has a durometer between about 40 A and about 70 A, wherein a volume of the insert is less than about 10% of a volume defined by the outer shell, and wherein the insert comprises a mesh material.

* * * * *